US009157288B2

(12) United States Patent
Martinez

(10) Patent No.: US 9,157,288 B2
(45) Date of Patent: Oct. 13, 2015

(54) DOWNHOLE TOOL SYSTEM AND METHOD RELATED THERETO

(75) Inventor: Edgar Martinez, Houston, TX (US)

(73) Assignee: General Plastics & Composites, L.P., Houston, TX (US)

( * ) Notice: Subject to any disclaimer, the term of this patent is extended or adjusted under 35 U.S.C. 154(b) by 576 days.

(21) Appl. No.: 13/553,785

(22) Filed: Jul. 19, 2012

(65) Prior Publication Data

US 2014/0020911 A1 Jan. 23, 2014

(51) Int. Cl.
*E21B 33/129* (2006.01)
*E21B 23/01* (2006.01)
*E21B 33/124* (2006.01)

(52) U.S. Cl.
CPC ..... *E21B 23/01* (2013.01); *E21B 33/124* (2013.01); *E21B 33/129* (2013.01); *E21B 33/1291* (2013.01)

(58) Field of Classification Search
CPC ..... E21B 33/129; E21B 33/1291; E21B 33/1292; E21B 33/1293
See application file for complete search history.

(56) References Cited

U.S. PATENT DOCUMENTS

| | | | | |
|---|---|---|---|---|
| 2,230,712 | A | 2/1941 | Bendeler et al. | |
| 3,687,196 | A | 8/1972 | Mullins | |
| 3,769,127 | A | 10/1973 | Goldsworthy et al. | |
| 3,910,348 | A | 10/1975 | Pitts | |
| 4,436,150 | A | 3/1984 | Barker | |
| 4,784,226 | A | 11/1988 | Wyatt | |
| 5,806,590 | A | 9/1998 | Lembcke et al. | |
| 5,839,515 | A | 11/1998 | Yuan et al. | |
| 5,906,240 | A | 5/1999 | Kilgore et al. | |
| 5,967,352 | A | 10/1999 | Repp et al. | |
| 5,984,007 | A | 11/1999 | Yuan et al. | |
| 6,026,899 | A | 2/2000 | Arizmendi et al. | |
| 6,112,811 | A | 9/2000 | Kilgore et al. | |
| 6,167,963 | B1 * | 1/2001 | McMahan et al. | 166/179 |
| 6,213,204 | B1 | 4/2001 | Doane et al. | |
| 6,302,217 | B1 | 10/2001 | Kilgore et al. | |
| 6,354,372 | B1 | 3/2002 | Carisella et al. | |
| 6,378,399 | B1 | 4/2002 | Bangert et al. | |
| 6,491,108 | B1 | 12/2002 | Slup et al. | |
| 6,491,116 | B2 | 12/2002 | Berscheidt et al. | |
| 6,578,633 | B2 | 6/2003 | Slup et al. | |
| 6,712,153 | B2 | 3/2004 | Turley et al. | |
| 6,755,097 | B2 | 6/2004 | Bangert et al. | |
| 6,796,376 | B2 | 9/2004 | Frazier et al. | |
| 6,976,534 | B2 | 12/2005 | Sutton | |

(Continued)

FOREIGN PATENT DOCUMENTS

| | | |
|---|---|---|
| EP | 1116860 | 7/2001 |
| WO | 2011097091 A2 | 8/2011 |
| WO | 2015069886 | 5/2015 |

OTHER PUBLICATIONS

Search Report and Written Opinion dated Mar. 19, 2013 for International Application No. PCT/US2012/050197 (8 pgs.).

*Primary Examiner* — Giovanna C Wright
(74) *Attorney, Agent, or Firm* — Timothy S. Westby; Porter Hedges LLP

(57) ABSTRACT

A slip and cone assembly for a downhole tool that includes a composite slip having a one-piece configuration and having at least two grooves disposed therein; and a cone having a first end configured for engagement with the composite slip, wherein the composite slip and the cone are configured for application of a load therebetween that results in a fracture in material between the at least two grooves.

47 Claims, 12 Drawing Sheets

(56) References Cited

U.S. PATENT DOCUMENTS

| | | | | |
|---|---|---|---|---|
| 7,124,831 | B2 | 10/2006 | Turley et al. | |
| 7,198,110 | B2 | 4/2007 | Kilgore et al. | |
| 7,341,110 | B2 | 3/2008 | Doane et al. | |
| 7,350,569 | B2 | 4/2008 | Collins et al. | |
| 7,389,823 | B2 | 6/2008 | Turley et al. | |
| 7,475,736 | B2 | 1/2009 | Lehr et al. | |
| 7,600,572 | B2 | 10/2009 | Slup et al. | |
| 7,665,516 | B2 | 2/2010 | Roberts et al. | |
| 7,690,424 | B2 | 4/2010 | McLeod et al. | |
| 7,735,549 | B1 | 6/2010 | Nish et al. | |
| 7,740,079 | B2 | 6/2010 | Clayton et al. | |
| 7,743,836 | B2 | 6/2010 | Cook et al. | |
| 7,779,906 | B2 | 8/2010 | Porter et al. | |
| 7,980,300 | B2 | 7/2011 | Roberts et al. | |
| 8,002,030 | B2 | 8/2011 | Turley et al. | |
| 8,002,045 | B2 | 8/2011 | Ezell et al. | |
| RE42,733 | E | 9/2011 | Gano et al. | |
| 8,047,279 | B2 | 11/2011 | Barlow | |
| 8,066,065 | B2 | 11/2011 | Buckner | |
| 8,408,290 | B2 | 4/2013 | Porter et al. | |
| 8,469,088 | B2 | 6/2013 | Shkurti et al. | |
| 8,579,024 | B2 | 11/2013 | Mailand et al. | |
| 8,596,347 | B2 | 12/2013 | Valencia et al. | |
| 8,770,276 | B1 | 7/2014 | Nish et al. | |
| 8,794,309 | B2 | 8/2014 | O'Malley | |
| 8,893,779 | B2 | 11/2014 | Treadaway et al. | |
| 8,936,102 | B2 | 1/2015 | Rood et al. | |
| 8,991,485 | B2 | 3/2015 | Chenault et al. | |
| 2003/0188876 | A1* | 10/2003 | Vick et al. | 166/382 |
| 2010/0276159 | A1 | 11/2010 | Mailand et al. | |
| 2011/0079383 | A1 | 4/2011 | Porter et al. | |
| 2011/0232899 | A1 | 9/2011 | Porter et al. | |
| 2012/0255723 | A1* | 10/2012 | Standridge | 166/134 |
| 2013/0048271 | A1* | 2/2013 | VanLue | 166/118 |
| 2014/0090831 | A1 | 4/2014 | Young et al. | |
| 2014/0216722 | A1 | 8/2014 | Badrak | |
| 2014/0251612 | A1 | 9/2014 | Powers | |
| 2015/0027737 | A1 | 1/2015 | Rochen et al. | |
| 2015/0068728 | A1 | 3/2015 | Stage et al. | |
| 2015/0068732 | A1 | 3/2015 | Rochen et al. | |

* cited by examiner

DOWNHOLE TOOL SYSTEM AND METHOD RELATED THERETO

STATEMENT REGARDING FEDERALLY SPONSORED RESEARCH OR DEVELOPMENT

Not applicable.

BACKGROUND

1. Field of the Disclosure

This disclosure generally relates to tools used in oil and gas wellbores. More specifically, the disclosure relates to downhole tools that may be run into a wellbore and useable for wellbore isolation, and methods pertaining to the same. In particular embodiments, the tool may be a frac plug or bridge plug having one or more parts made of composite drillable materials.

2. Background of the Disclosure

Oilfield drilling and production technology continues to evolve in order to attempt to meet the ever-increasing worldwide demand for valuable hydrocarbons. As reservoirs that contain hydrocarbons are typically found in layers that run parallel with the earth's crust, horizontal drilling technology was developed in order to maximize the amount of reservoir fluid accessible with a wellbore. In contrast to vertical drilling, which requires multiple vertical wellbore completions in order to produce from such a layer, only a single horizontal completion that runs through the reservoir is needed. Hence horizontal completions are inherently more efficient than vertical counterparts. The main constraint on this technology is how to drill and produce economically, as horizontal drilling is orders of magnitude costlier than vertical drilling. Thus, the industry is also continually striving to improve technology and reduce costs associated with horizontal drilling.

Among specific concerns, horizontal operations require higher pressure and faster flow rates, which tends to result in greater likelihood of parts or components of downhole tools loosening or disconnecting entirely. As a consequence of small tolerances between casing, tools, and parts of the tool, there is increased chance of catching something in the well during deployment, especially if anything is loose on the tool. This is of particular significance when it comes to deployment and operation of plugging tools.

Like horizontal drilling, fracing is a process that continues to grow in popularity, as it is known to enhance and assist production of formations. Typically, the frac process includes the use of a downhole plugging tool set in the wellbore below or beyond a respective target zone, which serves the function of being able to isolate a section of the wellbore in order to treat the zone. Isolation tools for this kind of operation are usually bodies constructed of durable metals that have a seal element made of compressible material associated therewith, where the seal element is expanded radially outward to engage the tubular and seal off a section of the wellbore. The setting of the tool is followed by pumping or injecting high pressure frac fluid into the target zone, resulting in fractures or "cracks" in the formation. The end result is the valuable hydrocarbons are more readily and easily produced through the fractures in the formation.

At present, the fundamental shift in the industry from vertical drilling to horizontal drilling has resulted in a void of technology selectively designed and useable specifically for horizontal drilling. That is, downhole tools, such as frac plugs, originally designed for vertical drilling operations are now used in horizontal operations, which ultimately means these tools do not work as well as they were designed to perform.

More problematic is that the use of plugs in a wellbore is not without other concerns, as these tools are subject to known failure modes regardless of wellbore orientation. For example, when the plug is run into the wellbore, slips have a tendency to loosen or pre-set before the plug reaches its destination, resulting in damage to the casing, as well as operational delays in order to fix the casing and/or deploy a new plug.

To combat pre-setting, operators typically wrap bailing wire (and the like) around the slips. Although this may prevent pre-setting, this has the inadvertent consequence of creating additional surfaces (i.e., surface areas) from which the tool may get caught up or catch against the tubular. Moreover, the wire is often wrapped around inserts disposed in the slip, thus rendering the inserts unable to smoothly or completely contact, and hence grip, the surrounding tubular surface. This results in unequal or inadequate load distribution during setting, and the tool is prone to being moved from the desired set position at a load far less than what it is designed for.

Frac fluid is also highly pressurized in order to not only transport the fluid into and through the wellbore, but also extend into the formation in order to cause fracture. Upon proper setting, the plug may be subjected to extreme pressure and temperature conditions, thus the plug must be capable of withstanding these conditions without destruction of either the plug or the seal formed by the seal element. High temperatures are generally defined herein as downhole temperatures above 200° F., and high pressures are generally defined herein as downhole pressures above 7,500 psi, and even in excess of 15,000 psi.

With these aspects in mind, it becomes imperative for an operator to be provided a downhole tool that can account for all of the problems associated with use of such a tool. As most problems encountered often center around the slips, the design and/or fabrication of such slips is typically the significant expense of the overall tool cost.

There are needs in the art for new and improved apparatus, systems, and methods for isolating wellbores in a viable and economical fashion. There remains a great need in the art for downhole plugging tools that form reliable engagement against a surrounding tubular, and are not subject to pre-setting. There is also a need for a downhole tool made substantially of a drillable material that is easier and faster to drill. It is highly desirous for these downhole tools to readily and easily withstand extreme wellbore conditions, and at the same time be cheaper, smaller, lighter, and useable in the presence of high pressures and flow rates associated with drilling and completion operations.

SUMMARY

Embodiments of the disclosure are directed to a slip and cone assembly for a downhole tool that may include a composite slip comprising a one-piece configuration and having at least two grooves disposed therein; and a cone having a first end configured for engagement with the composite slip, wherein the composite slip and the cone may be configured for application of a load therebetween that results in a fracture in material between the at least two grooves.

In some aspects, the composite slip may include a planar slip surface. In addition, the cone may include a planar cone surface configured to correspond to and engage with the planar slip surface. In other aspects, the composite slip may include a plurality of planar slip surfaces. Likewise, the cone may include a plurality of planar cone surfaces configured to engage with the respective plurality of planar slip surfaces. There may be at least two grooves disposed proximate to an area of intersection between two planar slip surfaces. There may be at least two grooves disposed proximate to an area of intersection between each of the plurality of planar slip surfaces. The cone may include a raised surface disposed proximate to each area of intersection between each of the plurality of planar cone surfaces. The composite slip may include a plurality of slip segments. One or more of the plurality of slip segments may have inserts disposed therein. The composite slip and/or the cone may each consist of or be made from filament wound drillable material. In some aspects, the composite slip may include or be made from cloth wrap material, while in other aspects the cone may include or be made from filament wound material.

In various embodiments, the configuration of each of the at least two grooves and each corresponding material therebetween may be designed to induce fracture in the material upon application of the load thereagainst. In some aspects, the load may be in the range of about 1500 to about 2500 lbf. In other aspects, the slip may be configured to expand in the range of about 0.00005" to about 0.001" before fracture occurs.

The composite slip may include an outer surface and an inner surface. In some aspects, at least one of the grooves has a depth. In further aspects, the depth of the at least one groove may be a distance from the outer surface to the inner surface. The slip may have a central axis, at least one slip segment may have an axis of unexpanded outer radius of curvature that may be different than the central axis. More particularly, each of the plurality of slip segments may have an axis of unexpanded outer curvature that may be different than the central axis.

In yet other aspects, the slip may include a central axis, each of the plurality of slip segments may have an axis of unexpanded outer curvature that may be different from the central axis. Each of the plurality of slip segments may have an axis of expanded outer curvature substantially similar to the central axis.

Other embodiments of the disclosure pertain to a slip and cone assembly for a downhole tool that may include a composite slip that may include a one-piece configuration and a grooved region disposed therein; and a cone that may have a first end configured for engagement with the composite slip. The grooved region may include a void (e.g., hole, notch, partial opening, void space, etc.) and a portion of material. The composite slip and the cone may be configured for application of a load therebetween that results in a fracture in the portion of material. The grooved region may be disposed proximate to an area of intersection between two slip surfaces.

In some aspects, the composite slip may include a plurality of slip surfaces. A plurality of cone surfaces may be configured to engage with the respective plurality of slip surfaces. In other aspects, the assembly may include a plurality of grooved regions. Accordingly, there may be a grooved region disposed in an area of intersection between each of the plurality of slip surfaces. One, more, or each of the grooved regions and each respective corresponding material therebetween may be designed in a manner such that fracture is inducted in the material upon application of the load thereagainst. The load may be a predetermined value or range. In particular, the load may be in the range of about 1500 to about 2500 lbf.

The composite slip may include an outer surface and an inner surface, and the void (or effective dimension of the void) may extend a distance from the outer surface to the inner surface. The slip may include a slip central axis. At least one slip segment may have an axis of unexpanded outer curvature offset from the slip central axis. Moreover, each slip segment may have an axis of unexpanded outer curvature offset from the slip central axis. And each of the plurality of slip segments may have an axis of expanded radius of curvature proximate to the slip central axis.

The composite slip may include a plurality of slip segments, and each of the plurality of slip segments may include inserts disposed therein. In aspects, the composite slip and/or the cone may consist of or be made from filament wound drillable material.

Yet other embodiments of the disclosure pertain to a downhole tool useable for isolating sections of a wellbore that may include a mandrel; a composite slip disposed about the mandrel and configured for engagement with a tubular member, where the composite slip may include a one-piece configuration and at least two grooves disposed therein; a cone disposed about the mandrel that may have a first end configured for engagement with the composite slip. Setting of the downhole tool in the wellbore may include fracturing or causing a fracture in the material between the at least two grooves. Upon sufficient fracture, the composite slip may move into gripping engagement with the tubular member.

The composite slip may include a slip planar surface. The cone may include a cone planar surface configured to correspond relative to and engage with the slip planar surface. The composite slip may include a plurality of slip planar surfaces. Accordingly, the cone may include a plurality of cone planar surfaces, which may be configured to engage with respective and corresponding slip planar surfaces.

There may be at least two grooves disposed proximate to an area of intersection between two slip planar surfaces. Also, there may be at least two grooves disposed proximate to each area of intersection between each of the plurality of slip planar surfaces. The cone may include a raised surface disposed proximate to each area of intersection between each of the plurality of cone planar surfaces. In aspects, the composite slip may include a plurality of slip segments, and one, more than one, or each of the plurality of slip segments may include inserts disposed therein. In particular, during setting of the tool a complete and total fracture (e.g., fracture of material) may occur between each slip segment. For example, the fracture may occur at an applied load of about 1400 to about 2500 lbf.

In other aspects, there may be at least one groove cut at a back angle in the range of about 20 degrees to about 90 degrees as measured from a central axis of the composite slip. Moreover, the mandrel, the composite slip, and/or the cone may each consist of or be made from filament wound drillable material. In particular, at least one of the mandrel, the composite slip, and the cone may be formed by wet winding one or more fibers having a phase angle of from about 30 degrees to about 70 degrees relative to a center line of the downhole tool.

One or more fibers may pass through a resin bath prior to winding the fibers. In some aspects, one or more fibers may include glass. In other aspects, one or more fibers may include carbon. In yet other aspects, one or more fibers may be wound in the presence of an epoxy resin blend comprising bisphenol A, epichlorohydrin, and one or more cycloaliphatic epoxy resins.

Components of the tool, such as the mandrel, the cone, and/or the composite slip may each include or be made from filament wound material wound at an angle in the range of about 0 degrees to about 90 degrees. The slip may expand at least 0.00005" during setting before fracture occurs. The slip may expand in the range of about 0.00005" to about 0.001"

before fracture. The composite slip may include a plurality of slip segments, and each of the plurality of slip segments may include inserts disposed therein.

In aspects, the downhole tool may be configured or used as a frac plug or a bridge plug. The composite slip may include an outer surface and an inner surface, wherein at least one of the grooves comprises a depth, and wherein the depth of the at least one groove is a distance from the outer surface to the inner surface.

In yet other embodiments the disclosure may pertain to a method of setting a downhole tool in order to isolate one or more sections of a wellbore that may include running the downhole tool into the wellbore to a desired position; placing the tool under a load that causes the cone to forcibly engage the slip, wherein the first slip breaks in at least one spot and expands radially outward into gripping engagement with a surrounding tubular when the load exceeds a predetermined value; and disconnecting the downhole tool from a setting device coupled therewith.

In some aspects, the downhole tool may include a mandrel; a composite slip disposed about the mandrel and configured for engagement with a tubular member, the slip comprising a one-piece configuration and having at least two grooves disposed therein; and a cone disposed about the mandrel and having a first end configured for engagement with the composite slip.

The method may include the downhole tool having at least one of the cone, the slip, or both, formed by wet winding one or more fibers having a phase angle of from about 30 degrees to about 70 degrees relative to a center line of the tool; and releasing the tool from the wellbore by drilling. In aspects, the break may occurs in the material between the at least two grooves.

The method may also include injecting a fluid from the surface into the wellbore, and subsequently into at least a portion of subterranean formation in proximate vicinity to the wellbore. In particular, the fluid may be a frac fluid. The frac fluid may be injected into at least a portion of the subterranean formation that surrounds the first section of the wellbore. The method may yet also include performing a fracing operation; setting a second downhole tool; and drilling through at least one of the downhole tool, the second downhole tool, or both.

Still yet other embodiments of the disclosure pertain to a method of manufacturing a slip and cone assembly that may include forming a composite member by winding a first layer of fibers at an angle of from about 30 degrees to about 70 degrees relative to a center line of the composite member, and winding a second layer of fibers at an angle of from about 30 degrees to about 70 degrees relative to the center line over at least a portion of the first layer to provide a desired thickness; forming a billet by using cloth wrap; machining the composite member to form the cone; milling the billet to form the slip; and placing the slip and cone together to form a separable slip and cone assembly.

The fibers of each layer may be at least substantially parallel to one another. The cloth may include prewoven fabric having fibers in multiple directions. Each layer may be wet wound with an epoxy resin. In some aspects, the epoxy resin may be a blend having one or more cycloaliphatic epoxy resins. In other aspects, the epoxy resin may be a blend comprising bisphenol A, epichlorohydrin, and one or more cycloaliphatic epoxy resins. The method may include curing the layers using thermal energy; may include curing the layers using ultraviolet light; may include curing the layers using a high energy electron beam.

These and other embodiments, features and advantages will be apparent in the following detailed description and drawings.

BRIEF DESCRIPTION OF THE DRAWINGS

For a more detailed description of the present invention, reference will now be made to the accompanying drawings, wherein.

DETAILED DESCRIPTION

Herein disclosed are a novel apparatus, system, and method that pertain to downhole tools usable for wellbore operations, details of which are described herein.

Figure 1A:
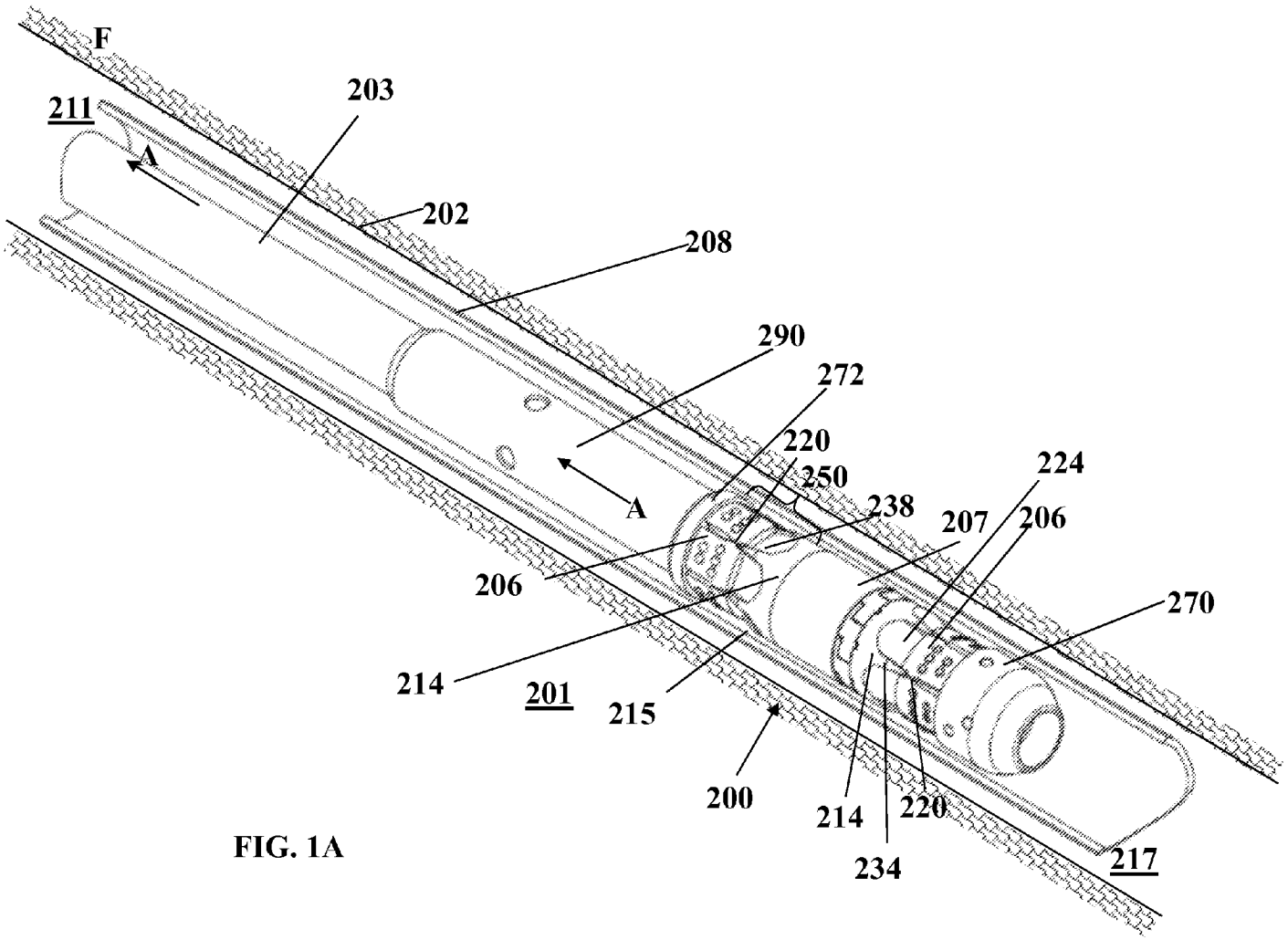
FIGS. 1A-1B show isometric, partially sectional, views of a system 201 that includes a downhole tool deployed and set, respectively, according to embodiments of the disclosure.
Figure 1B:
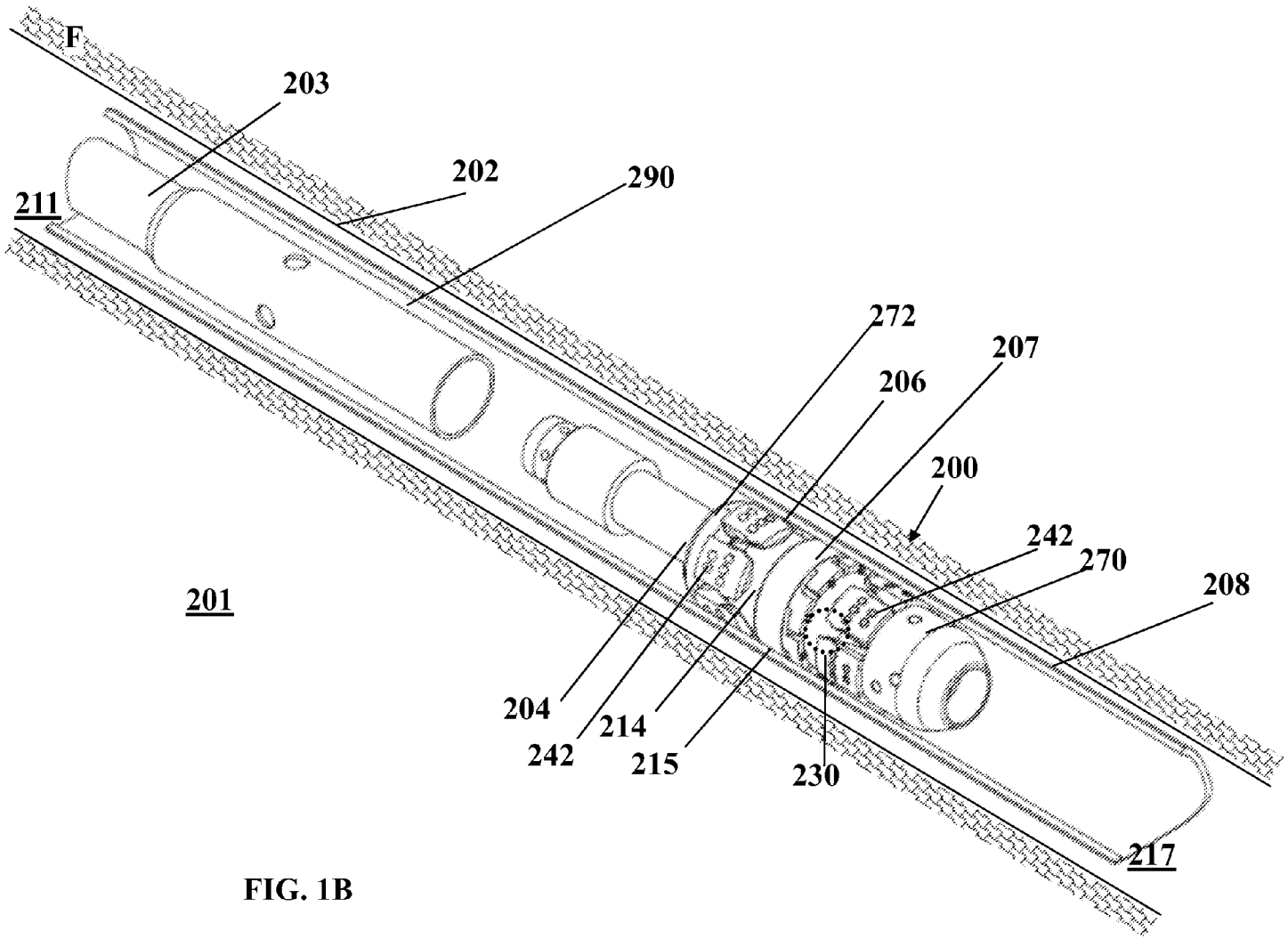

Referring now to FIGS. 1A and 1B, isometric views of a system 201 having a downhole tool 200 deployed and set, respectively, in accordance with embodiments disclosed herein, are shown. FIGS. 1A and 1B together show partial sectional views of a wellbore 202 formed in a subterranean formation, F, with a tubular member 208 disposed therein. In an embodiment, the tubular member 208 may be casing (e.g., casing, hung casing, casing string, cemented casing, etc.). A toolstring or workstring 203 (which may include an adapter 290 configured to couple the string 203 with the tool 200) may be used to position or run the downhole tool 200 into the wellbore 202 to a desired location.

The downhole tool 200 may be configured as a plugging tool, as would generally be known to one of skill in the art. The tool 200 may include one or more slip and cone assemblies 250. In this manner, the tool 200 may be set within the tubular member 208 so the tool 200 may form a fluid-tight seal (e.g., seal element 207 compressed and expanded) against the inner wall 215 of the tubular member 208, and held firmly in place by one or more slips 206 (expanded by corresponding cone(s) 214). In an embodiment, the downhole tool 200 may be configured as a frac plug and/or bridge plug, where fluid flow into one section 217 of the wellbore 202 may be blocked and otherwise diverted into the surrounding formation F.

Once the downhole tool 200 reaches the desired position within tubular member 208, the tool may be activated into an engaged position with the setting mechanism. The workstring 203 may be detached from the tool 200 by various methods, resulting in the tool 200 set in the surrounding tubular 208 and one or more sections 211, 217 of the wellbore isolated. In an embodiment, tension (or other suitable activation) may be applied to the adapter 290 until the connection (e.g., threads, pins, etc.) between the adapter and the mandrel 204 is broken. At this point, tool 200 may be considered set.

It would be apparent to one of skill in the art that the tool 200 of the present disclosure may be configurable as a frac plug, bridge plug, or the like, simply by utilizing one of a plurality of adapters or other optional components. In any configuration, once the tool 200 is properly set, fluid pressure may be increased in the wellbore, such that further downhole operations, such as perforation or fracture in a target zone, may commence.

Operation of the downhole tool 200 may allow for fast run in of the tool 200 to isolate one or more sections of the wellbore 202, as well as quick and simple drill-through to destroy or remove the tool 200. Drill-through of the tool 200 may be facilitated by components and sub-components of tool 200 made of drillable composite material that is less damaging to a drill bit than those found in conventional plugs. The drill bit may continue to work through the tool 200 until the slip(s) is drilled sufficiently that such slip loses its engagement with the wellbore, whereby any remaining portion of the tool 200 may free fall into the well.

Figure 2:
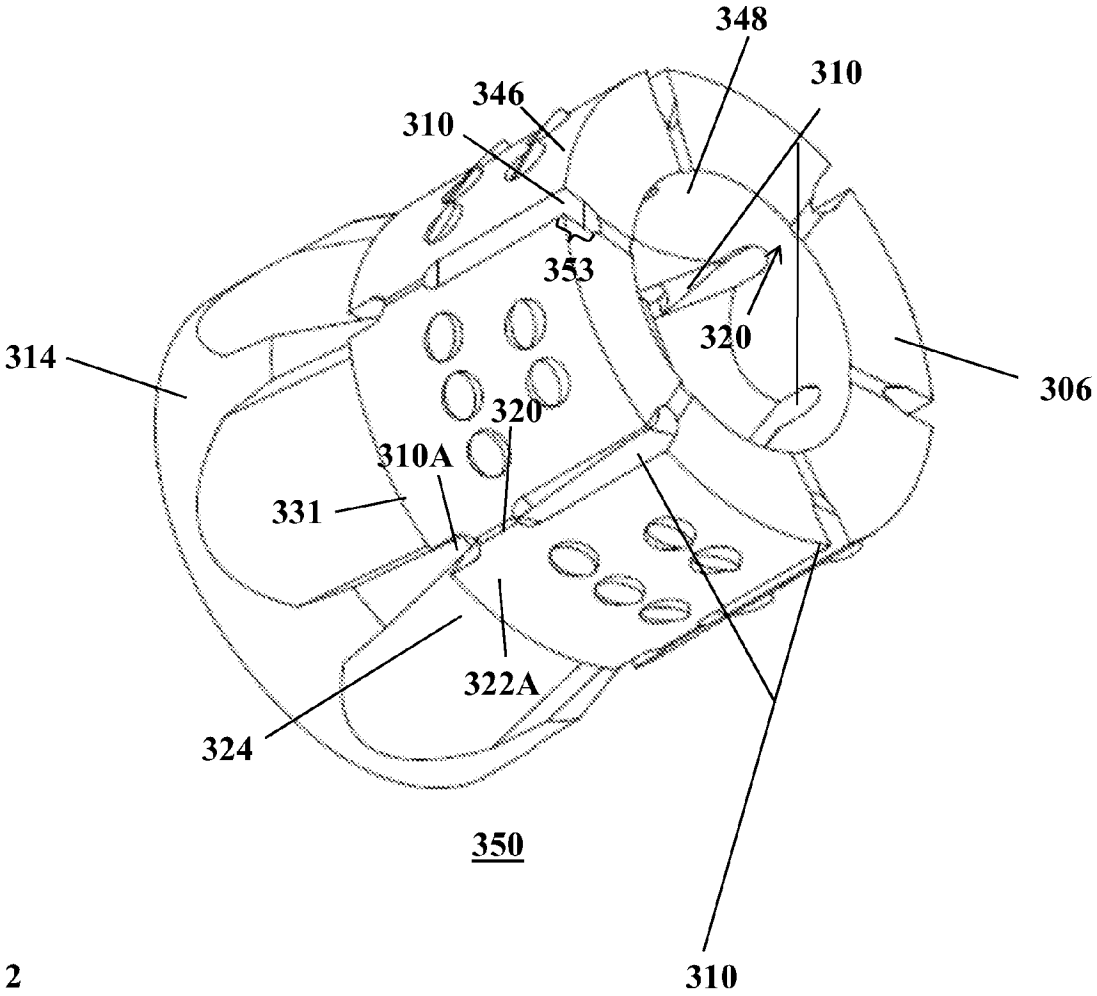
FIG. 2 shows an isometric view of a slip and cone assembly 350 (and its components) usable with a downhole tool, according to embodiments of the disclosure.

Referring now to FIG. 2, an isometric view of a slip and cone assembly 350 (and its subcomponents) usable with a downhole tool, in accordance with embodiments disclosed herein, are shown. A downhole tool (200, FIG. 1A) of the present disclosure may include a composite one-piece slip and wedge cone assembly 350, as described herein and understood to one of skill in the art. Although not shown here, it should be readily understood the tool may include a plurality of slip and cone assemblies (250, FIG. 1A).

Slip.

As illustrated, the assembly 350 may include a slip 306 having a single- or one-piece configuration. The use of a one-piece slip configuration (as compared to separate slip segments) may reduce the chance of presetting that is associated with conventional slips, as conventional slips are known for moving and/or expanding during run in. In an embodiment, slip 306 may be a one-piece slip, whereby the slip 306 is made with at least partial or complete connectivity around or along its circumferential body. This means while the slip 306 itself may have one or more grooves 310 formed therein, the slip 306 is configured with at least some continuity in material around the slip 306. In the present disclosure, the meaning of the term 'groove' may be interchangeable with any term synonymous with teaching one or more spatial features or elements that may be understood as being devoid of slip material (e.g., grooved region(s), void(s), notch(es), cut(s), indent(s), etc.)

Grooves 310 may be formed by known methods, such as such as by milling, laser, cutting, molding, grinding, and so forth. In an embodiment, at least two of the grooves 310 may be formed or disposed equidistantly and symmetrically from one another in the slip 306. In another embodiment, the disposition (e.g., spacing, placement, distribution, configuration, etc.) of at least one of the grooves 310 may be unequal or asymmetrical with respect to at least one other groove. In yet other embodiments, each of the grooves 310 may be may be equidistantly and symmetrically disposed in the slip 306 with respect to each other.

The dimensions (e.g., length, width, depth, radial, angle, etc.) of any particular groove 310 with respect to another groove may vary. However, two or more grooves 310 may have substantially similar or identical dimensions. The groove(s) 310 itself may have groove dimensions that are uniform or variable. As shown, a depth 353 of at least a portion of groove(s) 310 may extend partially and/or all the way through the slip 306 from an outer slip surface 346 to an inner slip surface 348 (e.g., slip OD to slip ID). It is within the scope of the disclosure that one or more dimensional values associated with the depth 353 of any grooves 310 may vary (e.g., such as along a length or width of the groove).

In an embodiment, the groove proximate to a first side 331 of the slip 310A may have sufficient dimension (e.g., length, width, etc.) such that a portion of the slip 322A may engage and/or contact the mating wedge surface 324. In some aspects, this mating length of groove 310 may be greater than 3/16", while in other aspects this length may be in the range between about ¼"-½". The grooves 310 may be have widths between about ⅛"-⅜". In an embodiment, the grooves 310 may be equally spaced radially around the slip 306. At least a portion of the groove(s) 310 may pass or extend from the OD to the ID of the slip 306. Any of the grooves may be machined at an angle of 90 to 20 degrees as measured from an axis (362, FIG. 5B).

In an embodiment, there may be a plurality of grooves 310 with an amount of material 320 therebetween. In areas where the slip 306 is partially (or wholly) devoid of slip material, that particular area of the slip 306 may be inclined to experience fracture or failure (as a result of load applied thereto) before other areas of the slip 306. Akin to this aspect, the material 320 may be configured in such a quantity or amount that the material 320 may be induced to fracture, including partial or complete fracture, before other areas of the slip 306.

Figure 3:
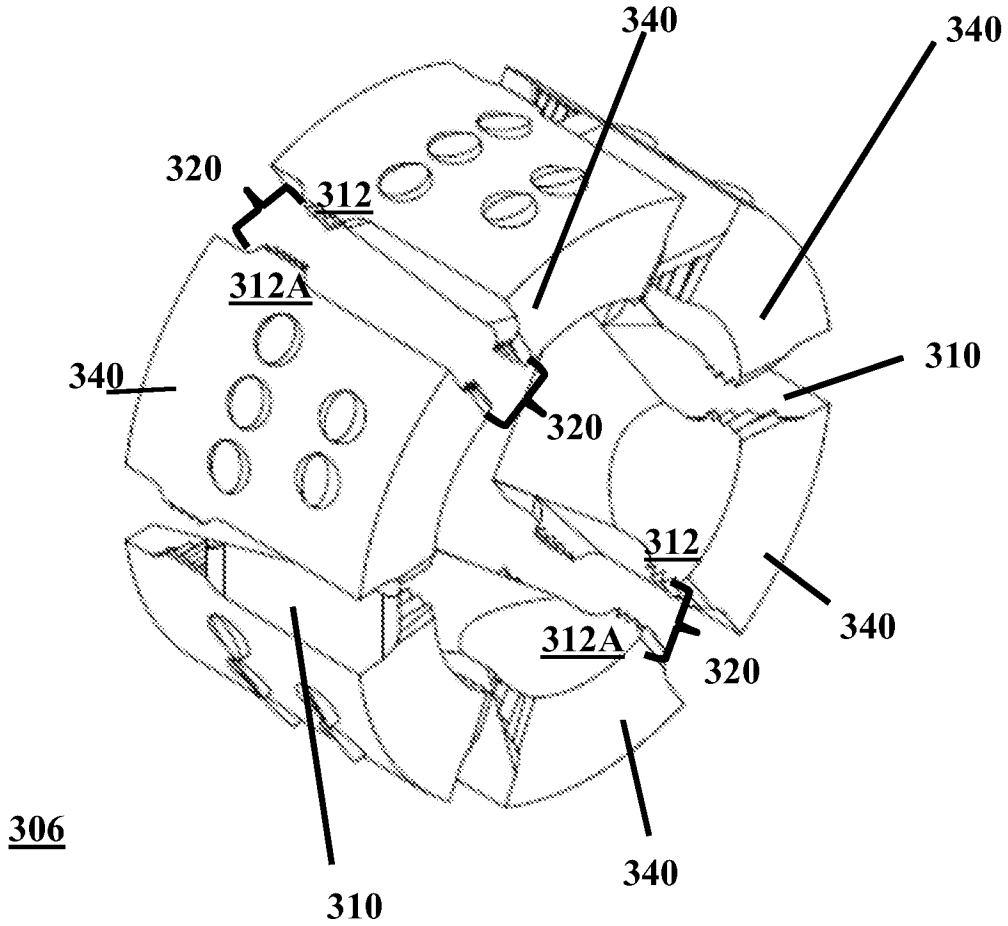
FIG. 3 shows an isometric view of a plurality of fractures in a composite slip 306, according to embodiments of the disclosure.

The fracture may be partial, in the sense that there is not a complete break throughout the material 320. Referring briefly to FIG. 3, the slip 306, and hence the material 320 between grooves 310, may be, for example, made of a plurality of fibers (strands, threads, etc.), where partial fracture may be slight breakage (e.g., tearing, etc.) that occurs between one or more fibers (not shown) in the material 320.

This type of induced and/or incurred fracture is a significant technical distinction over conventional metal slip bands. Metal slip bands are made of an isotropic material that has similar physical properties in all directions, and the regular failure or break is in the smallest cross-section. In contrast, the slip 306 of the present disclosure may be made from a composite material which may generally be considered as being anisotropic with different physical properties that depend upon orientation of the reinforcement. With composites, it is possible to make two or more cross-sections of the same size from the same reinforcing material and same matrix material but have two very different breaking strengths. Thus the cross-section alone is no longer determinative of breakage at a given point.

As such, the interface between the reinforcement and the resin matrix will affect performance of the larger composite structure. Design criteria are of paramount consideration, as the break or fracture occurring in the composite may not be clean or complete, which may result in damage to structures that should remain intact for proper performance of the slip 306. This may be addressed, for example, with a design that minimizes and/or optimizes the cross-sectional areas that exist between the slip segments 340. The shape and location of the cross-sectional area may also determine how the breaks will occur. Thus, the engineering and design of the slip 306, and the grooved regions 330 (including grooves 310 and amount/configuration of material 320) is a significant advancement of prior art designs.

In this manner, the arrangement or position of the groove(s) 310 of the slip 306 may be designed and formed as desired in order to induce fracture in a specific part of the slip 306. Although not limited to any particular design, the slip 306 may be designed with grooves 310 that promote about equal fracture in material proximate to all the grooves 310, such that upon expansion or flare, the slip 306 provides substantially equal distribution of radial load when the slip 306 is engaged with a tubular (208, FIG. 1B).

In an embodiment, partial fracture may be complete breakage between one or more fibers in the material 320. In yet another embodiment shown in FIG. 3, complete fracture between slip segments 340 may be complete breakage or separation between multiple fibers in the material 320, whereby an area 312 of a slip segment 340 may break free from a corresponding area 312A of another slip segment 340A.

Figure 5B:
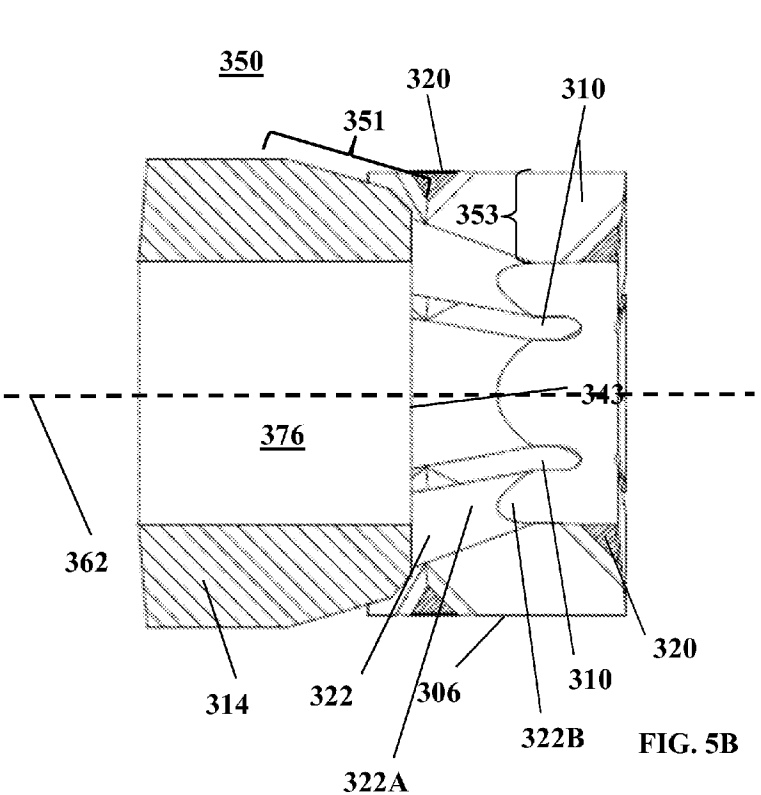
FIGS. 5A-5C show a lateral external view, and corresponding longitudinal, and rotated longitudinal, cross-sectional views, respectively, of a slip and cone assembly, according to embodiments of the disclosure.
Figure 5A:
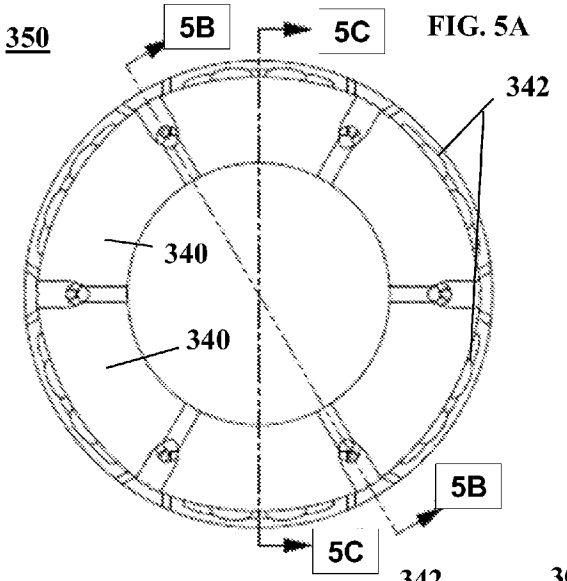
Figure 5C:
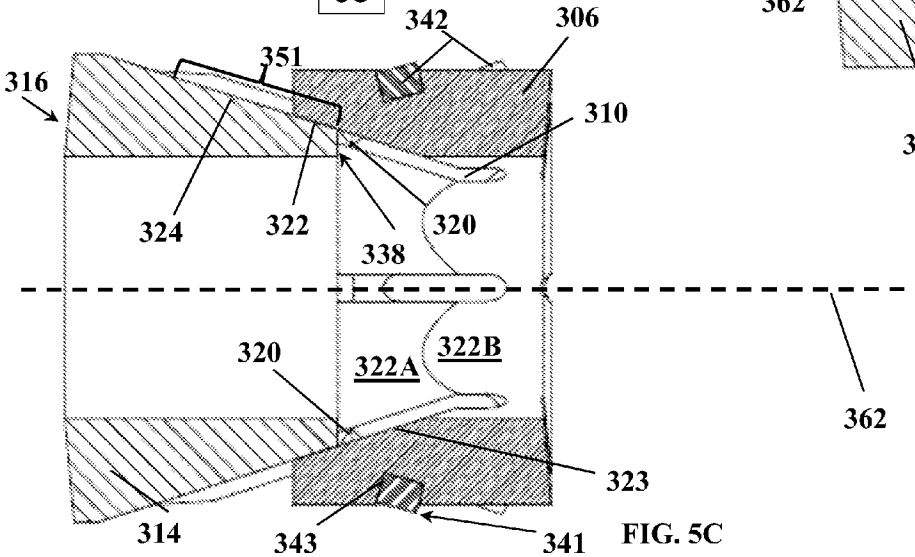

Referring now to FIGS. 5A, 5B, and 5C, a lateral external view, and corresponding longitudinal, and rotated longitudinal, cross-sectional views, respectively, of a slip and cone assembly 350, in accordance with embodiments disclosed herein, are shown. FIGS. 5A, 5B, and 5C together illustrate the slip 306 may have one or more slip surfaces with varying angles (with respect to assembly axis or centerline 362). For example, there may be a first angled slip surface 322 and a second angled slip surface 323. It should be understood the degree of any angle of the slip surface(s) with respect to axis 362 is not limited to any particular degree. Moreover, slip surface 322 may include partially planar or flat components, which means (by way of example) the slip 306 may have one portion 322A of slip surface 322 that may be substantially flat, and another portion 322B of slip surface 322 that may be rounded or configured with curvature.

The slips 306 may include devices for gripping a surrounding tubular (208, FIG. 1B), such as a plurality of inserts or buttons 342 (or other comparable gripping elements, including serrations or teeth). In some embodiments, the slip 306 may include one or more linear or uniform rows and/or columns of inserts 342, while in other embodiments, the slip 306 may include inserts 342 in an offset row and/or column manner. In yet other embodiments there may be a combination of offset and uniform configuration (e.g., inserts 342 shown here as disposed in a substantially linear row(s) and offset column (s) configuration) around the body of the slip 306.

The inserts 342 may be epoxied into corresponding insert grooves 343 formed in the slip 306, as would be understood to one of skill in the art. One or more of the inserts 342 may have a sharpened (e.g., machined) edge or corner 341, which may allow the insert(s) 342 greater biting ability. As such, the inserts 342 may be arranged or configured whereby the slip 306 may engage or "bite" the tubular (not shown) in such a manner that movement (e.g., longitudinally axially) of the slip 306 (or tool) is prevented once the tool is set. Inserts are not limited to the button style insert and may be made from ceramic, carbide, or cast iron. The insert can also be shaped in a traditional "wicker" form with multiple rows of sharp teeth that can engage the casing, as would be apparent to one of skill. The inserts 342 may be integrated with the slip 306 in a manner that may provide a range of about 0.060"-0.090" of "bite".

Wedge Cone(s).

As shown, there may be a cone 314 (e.g., "wedge", "wedge cone", etc.) disposed around a mandrel (204, FIG. 1B), and configured for engagement with the slip 306. The end 338 of the cone 314 may be configured with a cone profile 351, which may encompass an effective cone OD at end 338 being smaller than an effective cone OD at a second end 316. In an embodiment, the cone profile may be configured to mate with a corresponding inner profile of the slip 306. FIG. 5C shows the cone 314 may be configured with at least one cone surface 324 angled (or sloped, tapered, etc.) with respect to axis 362.

As load is applied through the assembly 350, the end 338 of the cone 306 may be moved against, engaged, or otherwise be in compression with, the slip 306 (e.g., slip surface(s) 322, 323 and cone surface(s) 324 compress against each other). In an embodiment, the cone 314 may be configured to cooperate with the slip 306, such that an underside of the slip 306 may be urged against an external side of the cone 314 (and/or vice versa).

Compression between the slip 306 and the cone 314 results in an application of load against or within material 320 that subsequently induces or causes at least a partial fracture into the material 320 of the slip 306. Once sufficient material 320 is fractured, the slip 306 may flare and move into engagement with the surrounding tubular (208, FIG. 2). In an embodiment, sufficient load may be applied to the slip 306 that results in fracture, whereby one or more slip segments 340 may flare radially outwardly into contact or gripping engagement with a tubular. The slip 306 may be configured to expand or flare in the range of about 0.00005" to about 0.001" before any fracture occurs.

After sufficient fracture, the slip 306 may be able to freely expand accordingly. In embodiments, the load that results in at least partial fracture may be in the range of about 1400 to about 3100 lbf. In other embodiments, the load may be in the range of about 1500 to about 2500 lbf. In yet other embodiments the load may be in the range from about 1000 to about 4000 lbf.

Figure 6A:
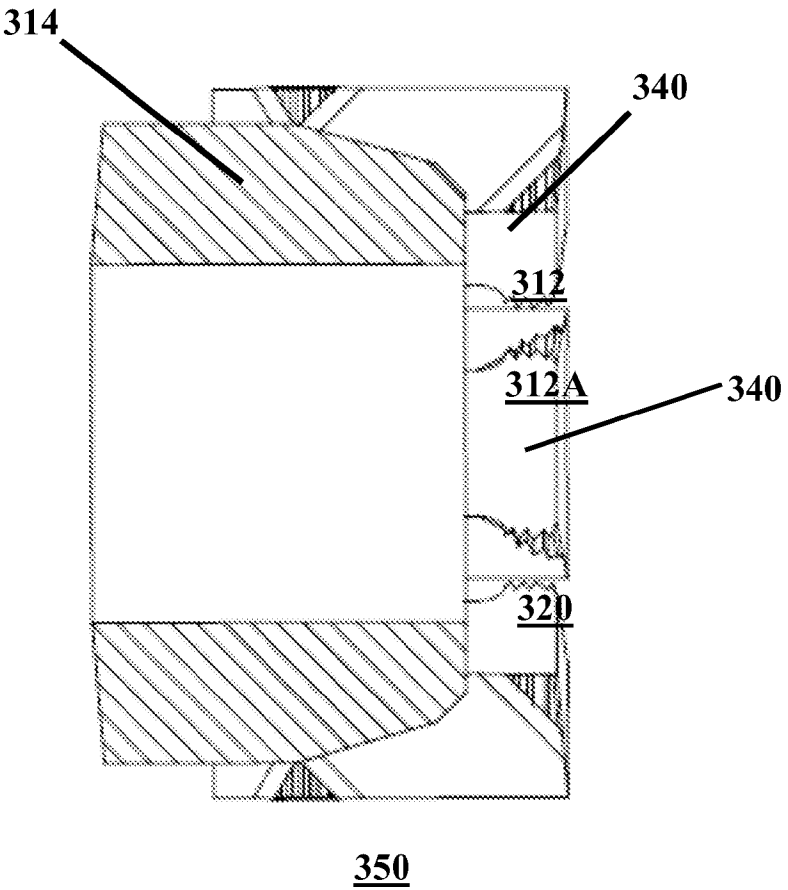
FIGS. 6A-6B show a longitudinal cross-sectional view, and rotated longitudinal cross-sectional view, respectively, of a fractured slip of a slip assembly, according to embodiments of the disclosure.
Figure 6B:
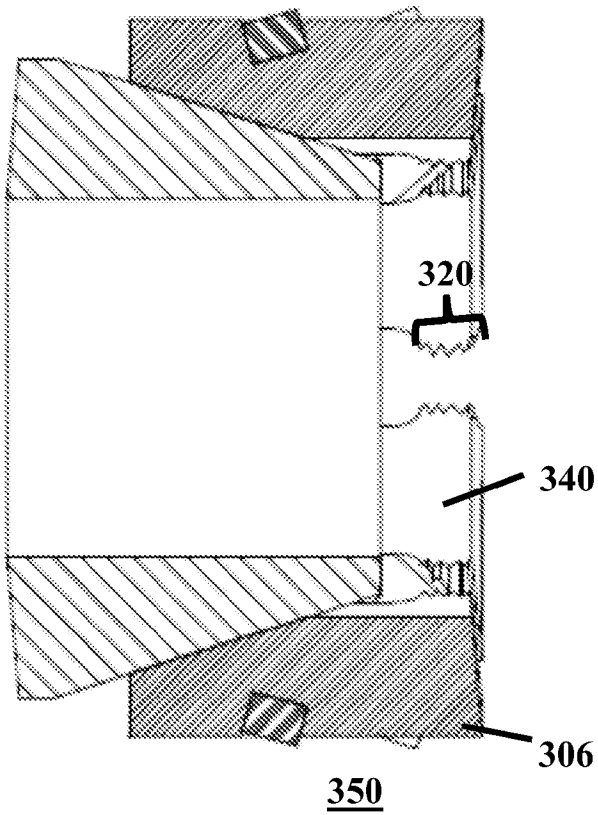
Figure 7B:
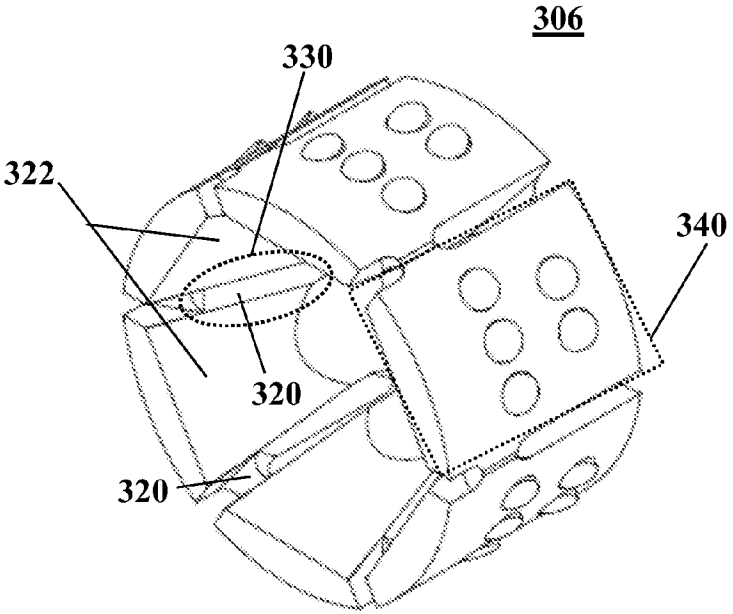
FIGS. 7A-7D show a top and bottom isometric view of a slip, and a top and bottom isometric view of a cone, respectively, according to embodiments of the disclosure.
Figure 7A:
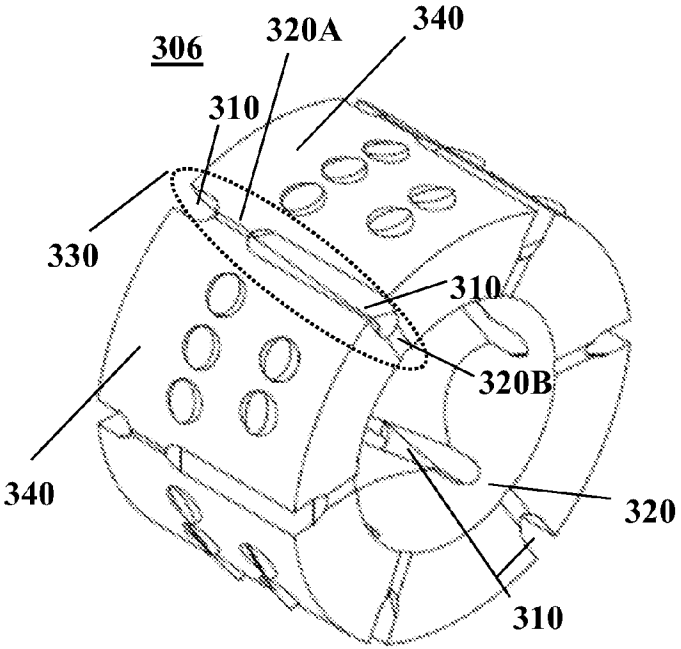
Figure 7D:
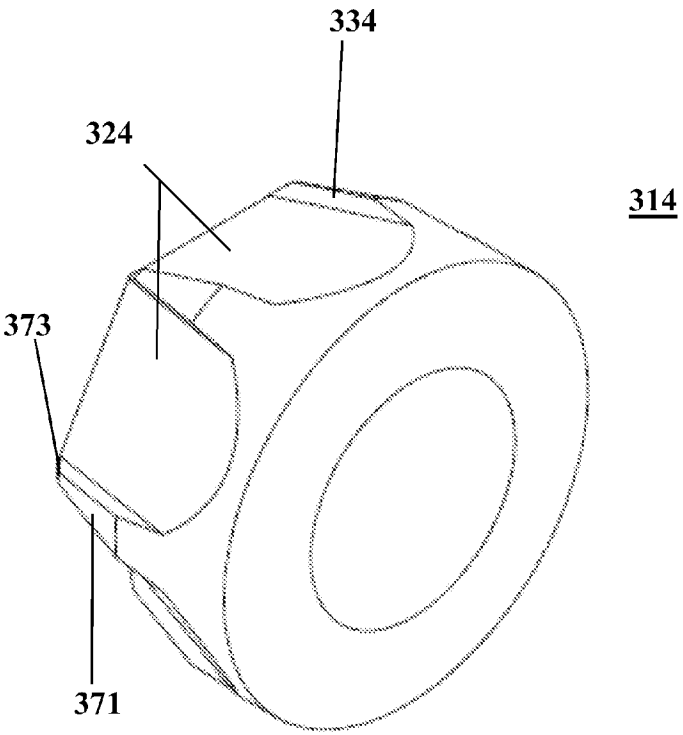
Figure 7C:
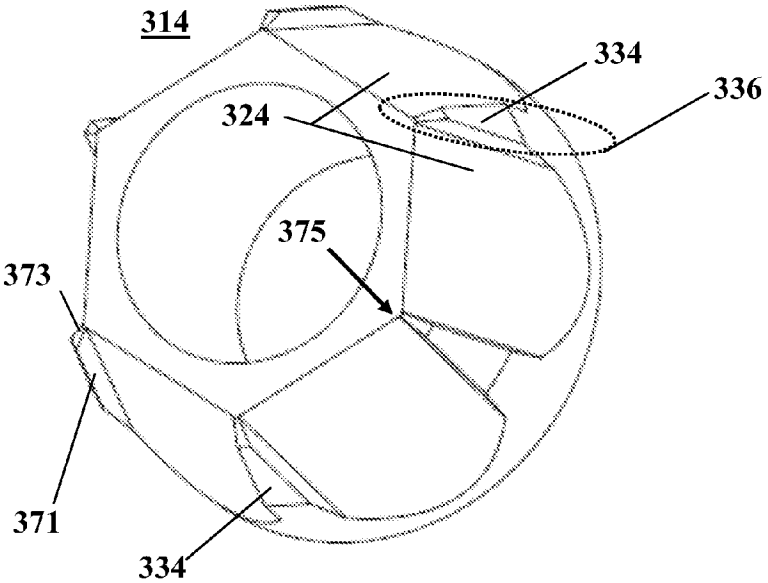

The fracturing load may be measured as the axial load required to cause fracture and substantial separation of at least two slip segments 340. Excessively high load may result in damage to the slip and/or slip segment(s) 340. It could also result in the slip 306 moving off of the matched wedge surface which leads to poor load distribution and premature tool failure. Briefly, FIGS. 6A and 6B show a longitudinal cross-sectional view, and rotated longitudinal cross-section view, respectively, of slip assembly 350, which illustrate together sufficient engagement between the slip 306 and the cone 314 that results in fracture of the material 320.

Referring now to FIGS. 7A, 7B, 7C, and 7D, a top and bottom isometric view of a slip, and a top and bottom isometric view of a cone, respectively, in accordance with embodiments disclosed herein, are shown. FIGS. 7A-7D together illustrate slip 306 may include one or more slip surfaces 322, any of which may include a partially planar surface or portion 322A. Similarly, the cone 314 may have a cone surface 324 that may have a partially planar portion, such that the cone surface 324 may include rounded portions and planar portions. In an embodiment, the cone surface 324 is substantially planar. In another embodiment, the cone surface 324 may be configured to correspond to and engage with the slip surface (s) 322. As shown, the slip 306 may include a plurality of slip surfaces 322, and the cone 314 may include a plurality of cone surfaces 324. In an embodiment, the plurality of slip surfaces 322 may be configured to engage with the respective plurality of cone surfaces 324.

In an embodiment, the may be at least two grooves 310 disposed proximate or into an area of intersection 330 between two slip surfaces 322 (or slip segments 340). In another embodiment, there may be at least two grooves 310 disposed proximate or into an area of intersection 330 between each of the plurality of slip surfaces 322. The configuration of each of the at least two grooves 310, and each corresponding material 320 therebetween, may be designed to induce fracture in the material 320 upon application of the load thereagainst. In some embodiments, at least one area 330 may include two break points of material 320 (e.g., 320A and 320B). In other embodiments, each area 330 between slip segments 340 may include at least two break points of material 320. In further embodiments, the fracture between all slip segments 340 may be substantially homogenous.

As shown, the cone 314 may include one or more a raised surfaces 334 disposed proximate to an area of intersection 336 between corresponding cone surfaces 324. The raised surfaces 334 may be fins or fin-shaped. The raised surfaces 334 may be configured to correspond with respective grooves 310 formed in the slip 306. In this manner the raised surfaces 334 may engage material 320 when the slip 306 and the cone 314 contact or compress together (see FIGS. 6A-6B), which may enhance or promote substantially complete fracture in the material 320. The raised surfaces 334 may have one or more tapered surfaces 371, 373. The raised surface(s) 334 may also have a convergent shape that results in a tip shape 375.

The raised surfaces 334 may be configured with geometry sufficient to ensure separation of the slip 306 into smaller separated slip segments 340. The raised surfaces 334 may be formed by two straight slots machined along an angle such that the faces will match the same "slip angle" on the mating slip features (e.g., grooves 310, material 320, etc.). The slip angle may range from 10 to 30 degrees. A series of 4 to 8 slots may be equally spaced radially about the axis 362. In an embodiment, one or more raised surfaces 334 may have a triangular shape. The triangular shape of the surface 334, with the wedge surface 324, acts like a wedge to aid in the separation of a single slip 306 into multiple slip segments 340. Poor separation of the slip segments 340 from a single slip 306 configuration can result in an uneven load condition and premature failure of the slips 306. The narrowed tip feature 375 of the raised surface 334 may be small enough to fit into the mating groove 310 of the slip 306. The load incurred by the assembly (350, FIG. 2A) is typically applied along the long face of the slots in which the slip segments 340 may expand outward into engagement with surrounding surfaces, such as the casing.

Figure 8B:
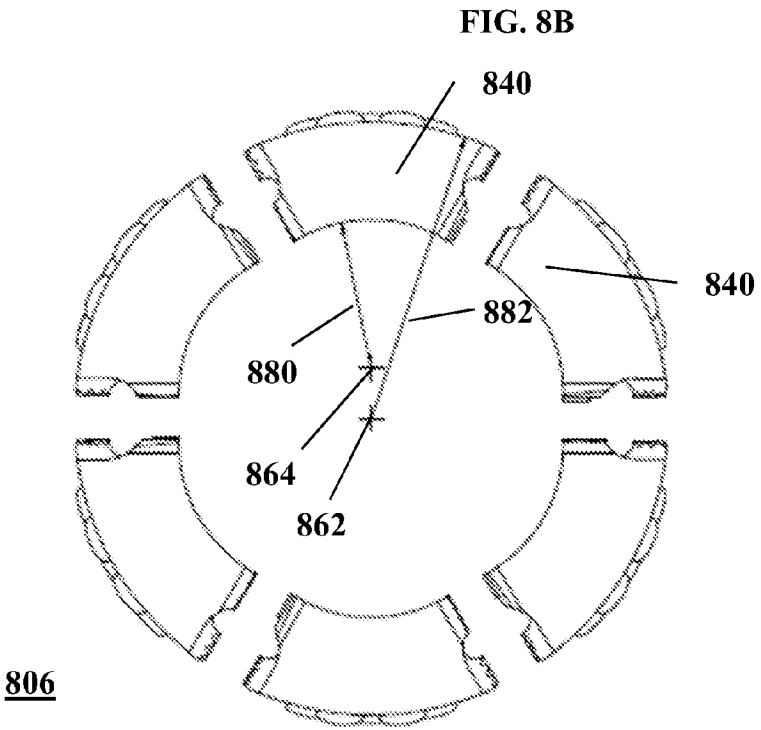
FIGS. 8A-8B show lateral external views of a composite slip configured with varied axes of curvature, respectively pre and post fracture, according to embodiments of the disclosure.
Figure 8A:
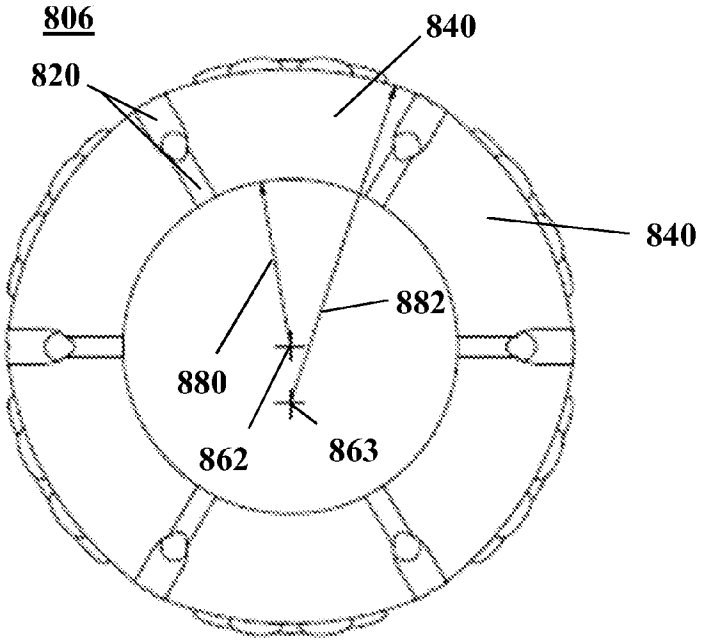

Referring briefly to FIGS. 8A and 8B, lateral external views of a slip 806 configured with offset axes of curvature are shown pre- and post-fracture, respectively. FIGS. 8A and 8B together illustrate that the slip 806 may be configured with an inner curvature based on radius 880 that is centered on axis 864, and an outer curvature based on radius 882 that is centered on axis 863. Axes 863 and 864 may be offset from each other. Similarly, one or more of the slip segments 840 may have an inner curvature and an outer curvature that are substantially similar to a central axis 862 of slip 806.

In an pre-fracture state or configuration (e.g., no fracture in material 820), the inner curvature of the slip 806 may have the inner radius 880 centered on or proximate to central axis 862, while in a post-fracture state (e.g., at least partial fracture in material 820) the inner curvature of the slip 806 may have the inner radius 880 centered on an axis 864 that is offset (e.g., eccentric, etc.) from central axis 862. Similarly, in an pre-fracture state, the outer curvature of the slip may have the outer radius 882 centered on an axis 863 is that is offset from central axis 862, while in a post-fracture state the outer curvature may have the outer radius 882 centered on or proximate to central axis 862.

In this manner, a distinct feature of the assembly (350, FIG. 2) is that at least one slip segment 840 may have an axis of outer curvature 863 that is different from the axis of inner curvature 864 of the slip segment 840. In an embodiment, each of the plurality of slip segments 840 may have an axis of outer curvature that is different from an axis of inner curvature of the corresponding slip segment. In another embodiment, the slip 840 may include a central axis 862, each of the plurality of slip segments has an unexpanded axis of outer curvature that is offset from the central axis 862 of the slip 806 and/or offset from a respective axis of inner curvature of the slip segment.

Materials and Manufacture.

The components (including subcomponents and features) of assembly 350 of the present disclosure may be made from composite materials, such as filament wound drillable material, which may be made of various phase or winding angles (as desired) to increase strength of the components in axial and/or radial directions.

A composite assembly may be able to resist high differential pressures without sacrificing performance or suffering mechanical degradation, and is considerably faster to drill-up than a conventional element system. A composite assembly may be capable of sealing an annulus in very high or low pH environments, as well as at elevated temperatures and high pressure differentials.

The assembly 350 may include one or more components (e.g., slip 306 and/or cone 314) made of a fiber reinforced polymer composite that is compressible and expandable or otherwise malleable. In an embodiment, the composite material comprises an epoxy blend reinforced with glass fibers stacked layer upon layer at an angle of about 0 to about 90 degrees. In an embodiment, the angle may be in the range of about 30 to about 70 degrees. The difference in the winding phase may be dependent on the desired strength and rigidity of the overall composite component or assembly.

The composite material may be constructed of a polymeric composite that may be reinforced by a continuous fiber such as glass, carbon, or aramid, for example. The individual fibers may be layered substantially parallel to each other, and wound layer upon layer. However, each individual layer may be wound at an angle of about 30 to about 70 degrees to provide additional strength and stiffness to the composite material in high temperature and pressure downhole conditions.

The composite may be an epoxy blend, such as, for example, anhydride cured epoxy. However, the composite may also consist of polyurethanes or phenolics, for example. In one aspect, a polymeric composite may be a blend of two or more epoxy resins. In an embodiment, the composite is a blend of a first epoxy resin of bisphenol A and epichlorohydrin and a second cycoaliphatic epoxy resin. For example, the cycloaphatic epoxy resin may be ARALDITE® liquid epoxy resin, commercially available from Ciba Geigy Corporation of Brewster, N.Y. A 50:50 blend by weight of the two resins may provide the required stability and strength for use in high temperature and pressure applications. The 50:50 epoxy blend may provide good resistance in both high and low pH environments.

The fiber may be wet wound, however, a prepreg roving may also be used to form a matrix. A post cure process may be used to achieve greater strength of the material. The post cure process may be a two stage cure consisting of a gel period and a cross linking period using an anhydride hardener, as is commonly know in the art. Heat may be added during the curing process to provide the appropriate reaction energy which drives the cross-linking of the matrix to completion. The composite may also be exposed to ultraviolet light or a high-intensity electron beam to provide the reaction energy to cure the composite material.

Methods of manufacturing composite members or components, such as a composite slip and cone assembly 350, within the scope of the disclosure include, for example, forming a composite member by winding a first layer of fibers at an angle of from about 30 degrees to about 70 degrees relative to a center line 362, and winding a second layer of fibers at an angle of from about 30 degrees to about 70 degrees relative to the center line 362 over at least a portion of the first layer The method may include winding one or more additional layers of fibers at an angle of from about 30 degrees to about 70 degrees relative to the center line 362 of the component to provide a desired thickness. In an embodiment, the cone 314 may be manufactured by winding fibers in this manner.

In aspects, the fibers of each layer may be at least substantially parallel to one another. Any of the layers may be wet wound with an epoxy resin. In some aspects, the epoxy resin may be a blend comprising one or more cycloaliphatic epoxy resins. In other aspects, the epoxy resin may be a blend comprising bisphenol A, epichlorohydrin, and one or more cycloaliphatic epoxy resins.

In embodiments, the method may include curing the composite member for a predetermined amount of time. The method may include curing the layers using thermal energy; curing the layers using ultraviolet light; and/or curing the layers using a high energy electron beam.

The method may include forming a second composite member by cloth wrapping. In an embodiment, the slip 306 may be manufactured by wrapping one or more layers of cloth wrap around a mandrel to form a billet, and then machining (i.e., CNC machining) and/or milling at least one slip 306 from the billet. Cloth wrap may include fibers in a pre-woven or stitched pattern. Fibers in the cloth wrap may be oriented in multiple directions. The second composite member may be cured for a predetermined amount of time.

Accordingly, the method may also include forming a billet by using cloth wrap; machining the composite member to form the cone; milling the billet to form the slip; and placing the slip and cone together to form a separable slip and cone assembly.

Figure 9B:
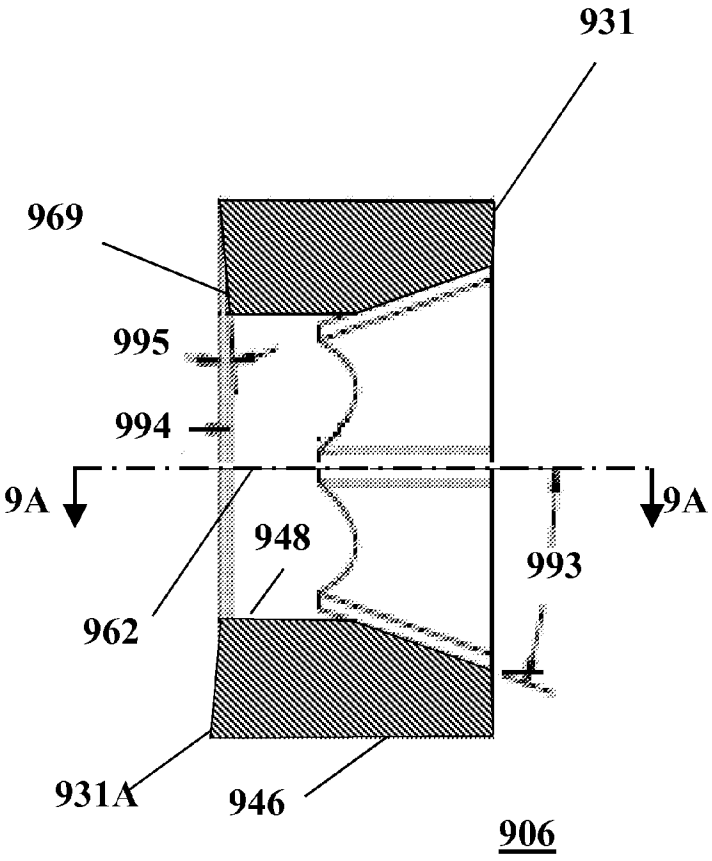
FIGS. 9A-9B show a longitudinal cross-sectional view, and rotated longitudinal cross-sectional view, respectively, of a slip component, according to embodiments of the disclosure.
Figure 9A:
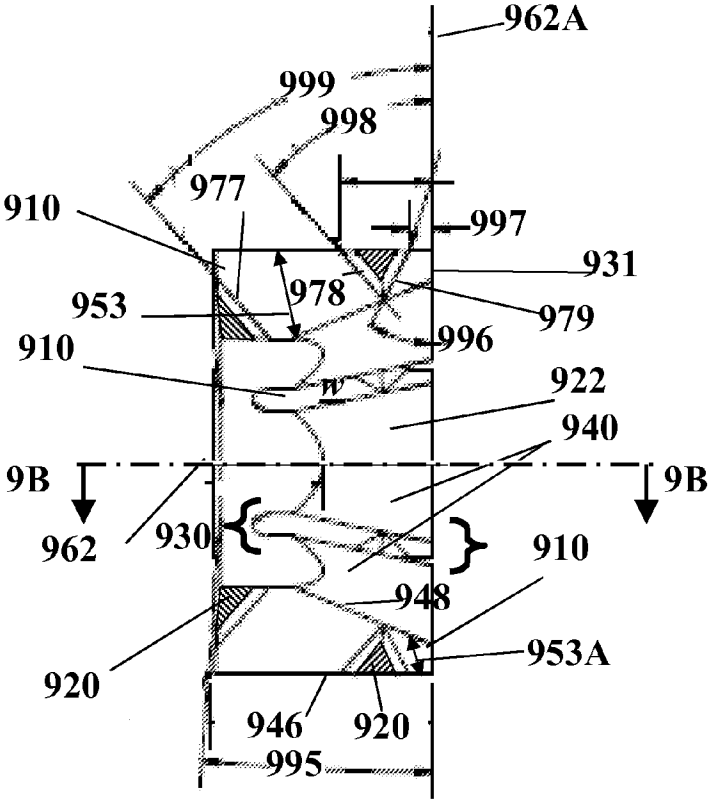

Referring now to FIGS. 9A and 9B, a cross-sectional view, and rotated cross-sectional view, respectively, of a composite slip, in accordance with embodiments disclosed herein, are shown. FIGS. 9A and 9B illustrate together a slip 906 usable with all embodiments of the disclosure. As such, the slip 906 may be a composite one-piece slip as previously described. The slip 906 itself may have one or more grooves (grooved regions, voids, etc.) 910 formed therein, as also previously described.

The dimensions (e.g., length, width, depth, radial, angle, etc.) of any particular groove 910 with respect to another groove may vary. However, two or more grooves 910 may have substantially similar or identical dimensions. The groove(s) 910 itself may have groove dimensions that are uniform or variable. As shown, a depth 953 of at least a portion of groove(s) 910 may extend partially and/or all the way through the slip 906 from an outer slip surface 946 to an inner slip surface 948 (e.g., slip OD to slip ID). It is within the scope of the disclosure that one or more dimensional values associated with the depth 953 of any grooves 910 may vary (e.g., such as along a length or width of the groove). For example, depth 953 may be different from depth 953A.

Figure 10A:
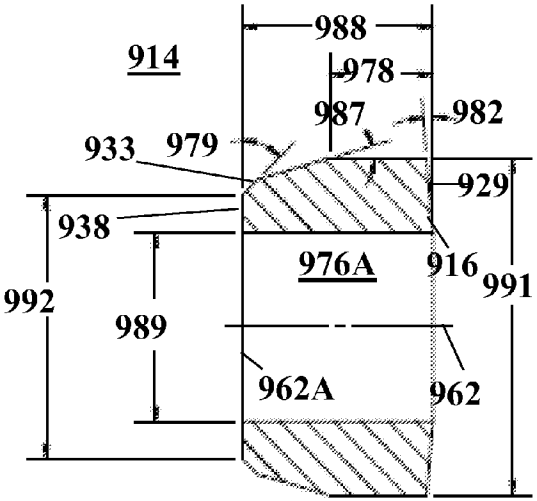
FIGS. 10A-10C show a longitudinal cross-sectional view, rotated longitudinal cross-sectional view, and lateral external view, respectively, and of a cone component, according to embodiments of the disclosure.

In an embodiment, the groove proximate to a first side 931 of the slip 906 may have sufficient dimension (e.g., length, width, etc.) such that a portion of the slip 906 may engage and/or contact a corresponding cone surface (e.g., 924, FIG. 10A). In some aspects, this mating length of groove 910 may be greater than 3/16", while in other aspects this length may be in the range between about ¼"-½". The grooves 910 may be have widths w between about ⅛"-⅜". In an embodiment, the grooves 910 may be equally spaced radially or circumferentially around the slip 906. At least a portion of the groove(s) 910 may pass or extend from the OD to the ID of the slip 906. Any of the grooves may be machined at an angle of 90 to 20 degrees as measured from an axis, for example, long (or central) axis 962 and/or lateral axis 962A.

In an embodiment, there may be a plurality of grooves 910 with an amount of material 920 therebetween. In areas where the slip 906 is partially (or wholly) devoid of slip material, that particular area of the slip 906 may be inclined to experience fracture or failure (as a result of load applied thereto) before other areas of the slip 906. Akin to this aspect, the material 920 may be configured in such a quantity or amount that the material 920 may be induced to fracture, including partial or complete fracture in region of material 930 between one or more slip segments 940, before other areas of the slip 906.

Formation of the grooves or removal of slip material may result in one or more material surfaces (e.g., 977, 978, 979). Any of these surfaces may have a respective angle associated with an axis, such as axis 962 and/or axis 962A. As shown by way of example, material surface 977 is associated with angle 999; surface 978 is associated with angle 998; and surface 977 is associated with angle 966. These dimensions may be the same or different. Moreover, the dimensions of any one particular groove 910 may vary from any other groove.

In an embodiment, the angle 998 and 999 may be the same. For example, angle 998 and angle 999 may be about 45 degrees. In other embodiments, angle 996 may be equal or unequal from angle 998 and/or angle 999. In an embodiment, angle 996 may be about 30 degrees. However, the dimension (s) of any of these surfaces or angles is not meant to be limited by the examples described here. Nor is there a limitation to linearity or straight surfaces, as it is within the scope of the disclosure that surfaces may be rounded or take other shape.

The slip 906 may have one or more slip surfaces with varying angles (e.g., with respect to axis or centerline 962). It should be understood the degree of any angle of any slip surface(s) is not limited to any particular reference or axis, nor limited to any particular degree. In some aspects, one or more slip surface(s) 922 may be formed at slip surface angle 933.

The slip may have a tapered surface 969. In an embodiment, the tapered surface 969 may extend from/between outside 946 to inside 948. The use of the tapered surface 969 may result from inclination of the side 931A at a slip taper angle 995. In an embodiment, taper angle 995 may be about 5 degrees. The slips 906 may include devices for gripping a surrounding tubular, such as a plurality of inserts or buttons (or other comparable gripping elements, including serrations or teeth)—not shown here.

Figure 10B:
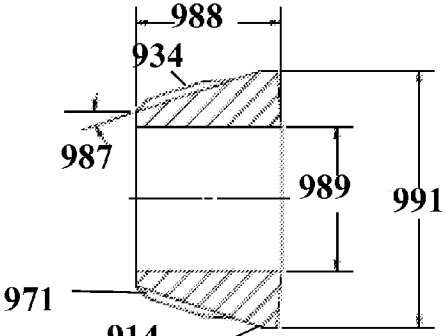
Figure 10C:
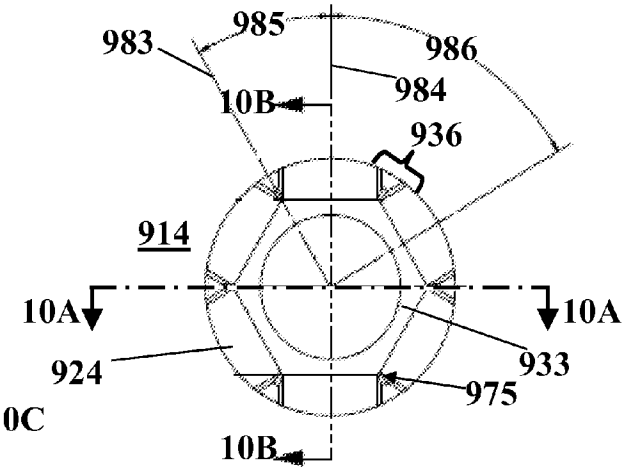

Referring now to FIGS. 10A, 10B, and 10C, a cross-sectional view, rotated cross-sectional view, and lateral external view, respectively, of a cone, in accordance with embodiments disclosed herein, are shown. FIGS. 10A-10C illustrate together a cone 914 usable with any and/or all embodiments of the disclosure. As such, the cone 914 may be a composite, and function as previously described.

The cone 914 may be configured for engagement with the slip (e.g., 906, FIG. 9A). The end 938 of the cone 914 may be configured with a cone profile, which may encompass an effective cone OD 992 at end 938 being smaller than an effective cone OD 991 at a second end 916. In an embodiment, the cone profile may be configured to mate with a corresponding inner profile of the slip. The cone 914 may be configured with at least one cone surface 924 angled (or sloped, tapered, etc.) with respect to axis or centerline 962. For example, surface 924 may have an angle 987 with respect to axis 962. In an embodiment, the angle 987 may be in the range of about 15 degrees to about 20 degrees.

The cone surface 924 may have a partially planar portion, such that the cone surface 924 may include rounded portions and planar portions. In an embodiment, the cone surface 924 is substantially planar. In another embodiment, the cone surface 924 may be configured to correspond to and engage with the slip (e.g., slip surface(s) 922, FIG. 9A).

As shown, the cone 914 may include one or more a raised surfaces 934 disposed proximate to an area of intersection 936 between corresponding cone surfaces 924. The raised surfaces 934 may be fins or fin-shaped. The raised surfaces 334 may be configured to correspond with respective grooves formed in a slip of the present disclosure. In this manner the raised surfaces 934 may engage the slip (e.g., slip material 920) when the slip and the cone contact or compress together (see FIGS. 6A-6B), which may enhance or promote substantially complete fracture in the material. The raised surfaces 934 may have one or more tapered surfaces 971. The raised surface(s) 934 may also have a convergent shape that results in a tip shape 975.

The raised surfaces 934 may be formed by two straight slots machined along an angle such that the faces will match the same "slip angle" on the mating slip features (e.g., grooves 910, material 920, etc.). The slip angle may range from 10 to 30 degrees. In an embodiment, one or more raised surfaces 934 may have a triangular shape. The triangular shape of the surface 934, with the wedge surface 924, may act like a wedge to aid in the separation of a slip body into multiple slip segments. The narrowed tip feature 975 of the raised surface 934 may be small enough to fit into the mating groove of the slip (906, FIG. 9A).

The raised surface 934 (alternatively, area of intersection 936) may have a centerline 983. Similarly, cone surface 924 may have a centerline 984. As shown, there may be an angle 985 between centerlines 983 and 984. The angle 985 may be equal to or unequal to the angle between other comparable angles pertaining to other raised surfaces 934. In an embodiment, angle 985 may be about 30 degrees. In the embodiment shown, the cone 914 may have substantial symmetry of its features and subcomponents such that applicable cone dimensions are about equal. For example, there may be six cone surfaces 924, each with a respective centerline 984, whereby the angle between adjacent centerlines 984 is about 60 degrees.

The cone 914 may include a circumferential taper surface 933 proximate to end 938. The slip may also have an inclined tapered surface 929. In an embodiment, the tapered surface 929 may extend from/between the outer cone surface to the inner cone surface. The use of the tapered surface 929 may result from inclination of the end 938 at a slip taper angle 982. In an embodiment, taper angle 982 may be about 5 degrees.

The cone 914 may have an inner flowpath by way of bore 976A, such that the cone 914 may have a cone inner diameter 989.

Methods of Operation and Setting.

Figure 4A:
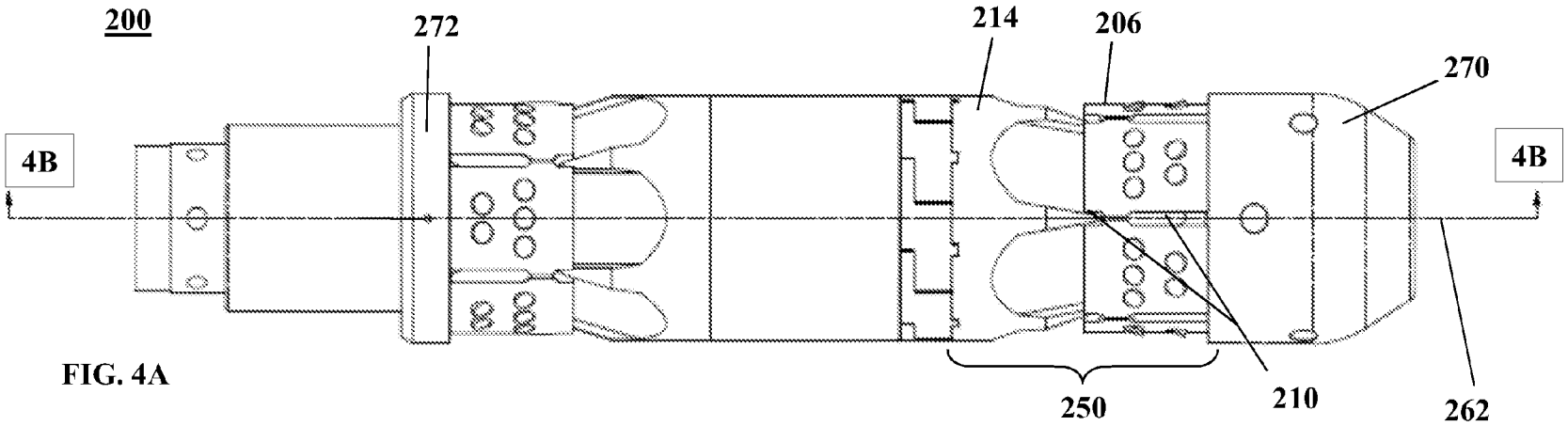
FIGS. 4A-4B show a longitudinal external and cross-sectional view, respectively, of a downhole tool, according to embodiments of the disclosure.
Figure 4B:
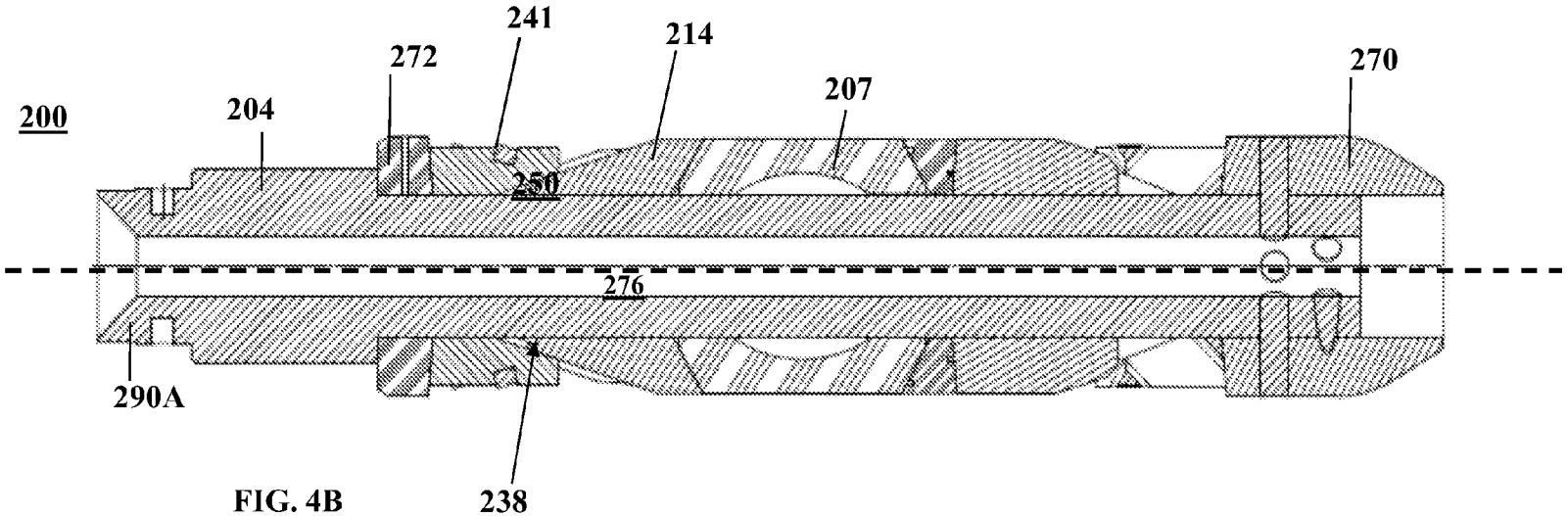

Embodiments of the present disclosure pertain to a method of setting a downhole tool 200 in order to isolate one or more sections of a wellbore 202, which may be understood, by way of example, with reference being made to FIGS. 1A-1B. Further reference may be made with respect to FIGS. 4A and 4B, which together illustrate a longitudinal external and cross-sectional view, respectively, of the tool 200. The method may include running the downhole tool 200 into the wellbore 202 to a desired position, the downhole tool 200 being configured with various components associated therewith. For example, the tool 200 may include a mandrel 204, and at least one composite slip 206 disposed about the mandrel 204 and configured for engagement with a tubular member 208. The slip 206 may have a one-piece configuration with at least two grooves 210 disposed therein. The tool 200 may include a cone 214 disposed about the mandrel 204, and also having a first end 238 configured for engagement with the composite slip 206.

The mandrel 204 may be sufficient in length, such that the mandrel may extend through a length of the tool 200. The tool 200 may include a bore, such as, for example, an axial bore 276 that extends through the entire mandrel 204. The bore may provide a flowpath for fluids to pass therethrough. Ends of the mandrel 204 may include internal or external (or both) portions, for example an end 290A, configured for coupling with adjacent components (e.g., with one or more shear pins), such as an adapter 290 (or wireline adapter, setting tool and the like) on one end, and a lower sleeve 270 on the other.

Once the tool 200 is in the desired position, tension may be applied through the tool 200 that may result in the lower sleeve 270 pulled in the direction of Arrow A (by way of attachment and/or coupling of the lower sleeve 270 to the mandrel 204). As this occurs, the components disposed about mandrel 204 between the lower sleeve 270 and a setting sleeve or bearing plate 272 may begin to compress against or toward one another, as would be apparent to one of skill in the art. This force and resultant movement may cause compression and expansion of seal element 207. The seal element 207 may be a conventional seal element configured to deform or compress, such as in an axial manner, during the setting sequence of the downhole tool 200. Thus, the seal element 207 may provide a fluid-tight seal by compressing against the tubular surface 215, as would also be apparent to one of skill in the art.

As the lower sleeve 270 continues further in the direction of Arrow A, the end of the sleeve 270 may compress against the slip 206. As a result, slip 206 may be moved or urged against surface(s) 224, 234 of the cone 214, and eventually radially outward into engagement with the surrounding tubular 208.

As such, the method may include placing the tool 200 under a load that causes the cone 214 and the slip 206 to forcibly engage and compress with one another, whereby the slip 206 breaks or fractures in at least one area 230. When the load exceeds a predetermined value, this may result in sufficient fracture in the material 220 in the area 230, whereby at least one slip segment 240 (FIG. 1B) may expand radially outward into engagement with the surrounding tubular 208. With sufficient fracture, each and every slip segment 240 (FIG. 1B) may expand radially outward into engagement with the surrounding tubular 208. In embodiments, the load that results in at least partial fracture may be in the range of about 1400 to about 3100 lbf. In other embodiments, the load may be in the range of about 1500 to about 2500 lbf.

The slip 206 may be used to lock the tool 200 in place by holding potential energy of compressed tool components in place. In an embodiment, the tool 200 may be unidirectionally locked, in the sense the slip 206 may prevent the tool 200 from moving as a result of fluid pressure against the tool from one direction. In another embodiment, the tool 200 may be bidirectional in nature, in the sense two or more slips 206 may be configured to prevent the tool 200 from moving as a result of pressure against the tool 200 from multiple directions (e.g., above and below).

Inserts 242 (or comparably, serrated surfaces or teeth) of the slip(s) 206 may be configured such that the inserts 242 bite into the tubular 208, and thus prevent the slip 206 (or tool 200) from moving (e.g., axially or longitudinally) within the surrounding tubular 208. Without sufficient bite, the tool 200 may inadvertently release or move from its position. The inserts 242 may have an edge, corner, surface, etc. 241 suitable to provide additional bite into the tubular surface 215. In an embodiment, the inserts 242 may be mild steel, such as 1018 heat treated steel.

The method may include disconnecting the downhole tool 200 from a setting device (or adapter 290) coupled therewith. Disconnect may occur, for example, by shearing pins or threads. The method may also include at least one component formed by wet winding one or more fibers having a phase angle of from about 0 degrees to about 90 degrees relative to a center line of the tool. In an embodiment, the phase angle may be in the range from about 30 degrees to about 70 degrees. There may be a plurality of composite slips 206, and a plurality of composite cones 214, each cone disposed adjacent to a respective slip. In an embodiment, additional tension or load may be applied to the tool 200 that results in analogous engagement (and movement) between a second slip and cone assembly 250.

The method may include injecting a fluid from the surface into the wellbore 202, and subsequently into at least a portion of subterranean formation F in proximate vicinity to the area of the wellbore 202 where the tool 200 is set. The fluid may be a frac fluid, as known in the art. The frac fluid may be injected into at least a portion of the subterranean formation that surrounds the first section 211 of the wellbore, as also known in the art. Accordingly, the method may include performing a fracing operation. In embodiments, the method may include setting a second downhole tool (not shown). In other embodiments, the method may include drilling through at least one of the downhole tool, the second downhole tool, or both.

Advantages.

Embodiments of the present disclosure may provide for a solid, robust composite slip component having little to no chance of pre-set, and has no need for a slip band or bailing wire. As the chance for pre-set is reduced, faster run-in times are possible, which results in faster completion and production.

Beneficially, the downhole tool of the disclosure may be smaller in size, which allows the tool to be used in slimmer bore diameters. Smaller in size also means there is a lower material cost per tool—a small cost savings per tool results in enormous annual capital cost savings.

A tool made of composite materials is friendly to PDC bits, and thus easily drilled through. A synergistic effect is realized because a smaller tool means faster drilling time is easily achieved. Even a small savings in drill-through time per single tool results in an enormous savings on an annual basis.

Beneficially, a slip according to embodiments of the disclosure may be engaged with a surrounding tubular around its circumference, with equal distribution of load. This results in a higher pressure rating of the tool, meaning the set tool can withstand significantly higher pressures. The ability to handle higher wellbore pressure results in operators being able to drill deeper and longer wellbores, as well as use greater frac fluid pressure. The ability to have a longer wellbore and increased reservoir fracture results in significantly greater production.

The slip allows for cost savings by reducing the amount of material required for construction. It also improves frac and bridge plug assembly by reducing the number of parts required.

Multiple plugs may be drilled up in a single run of the drill bit. Lighter materials may be flowed back out of the well during the milling or drill-thru process. This material is removed from the wellbore and disposed of appropriately, minimizing the amount of material left in the wellbore after milling.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The inclusion or discussion of a reference is not an admission that it is prior art to the present invention, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

I claim:

1. A slip and cone assembly for a downhole tool, the assembly comprising:

a composite slip comprising a one-piece configuration and having a plurality of planar slip surfaces; and a cone having a cone end configured for engagement with the composite slip, wherein the cone end comprises a plurality of planar cone surfaces configured to engage with the respective plurality of planar slip surfaces, wherein the cone end comprises a raised surface disposed proximate an area of intersection between at least two of the plurality of planar cone surfaces, wherein the raised surface comprises a tapered surface converging toward a narrowed tip, and wherein the composite slip and the cone are configured for application of a load therebetween that results in a fracture proximate to an area of intersection between at least two of the plurality of planar slip surfaces.

2. The assembly of claim 1, further comprising at least two grooves disposed proximate to the area of intersection between the at least two of the plurality of planar slip surfaces.

3. The assembly of claim 1, further comprising at least two grooves disposed proximate to each area of intersection between two of the plurality of planar slip surfaces.

4. The assembly of claim 1, wherein the composite slip comprises a plurality of slip segments, and each of the plurality of slip segments comprise inserts disposed therein.

5. The assembly of claim 4, wherein the load is in the range of about 1500 to about 2500 lbf.

6. The assembly of claim 5, wherein the composite slip and the cone comprise filament wound drillable material.

7. The assembly of claim 4, wherein the slip is configured to expand in the range of about 0.00005" to about 0.001" before fracture occurs.

8. The assembly of claim 7, wherein the composite slip comprises an outer surface and an inner surface, wherein at least one of the grooves comprises a depth, and wherein the depth of the at least one groove is a distance from the outer surface to the inner surface.

9. The assembly of claim 4, wherein the assembly comprises a central axis, wherein each of the plurality of slip segments has an axis of an unexpanded outer curvature that is offset from the central axis, and wherein each of the plurality of slip segments has an axis of an expanded outer curvature substantially similar to the central axis.

10. The downhole tool of claim 4, wherein the composite slip comprises cloth wrap material, and wherein the cone comprises filament wound material.

11. The assembly of claim 1, wherein the raised surface engages a groove in the composite slip.

12. The assembly of claim 1, wherein the tapered surface is triangular.

13. A slip and cone assembly for a downhole tool, the assembly comprising:

a composite slip comprising a one-piece configuration and having a grooved region disposed therein; and a cone having an end configured for engagement with the composite slip, wherein the composite slip comprises a plurality of slip planar surfaces, and wherein the cone comprises a plurality of cone planar surfaces configured to engage with the respective plurality of slip planar surfaces, wherein the grooved region is disposed proximate to an area of intersection between two of the plurality of slip surfaces, wherein the grooved region comprises a void and a-portions of material, wherein the portions of material comprise first and second break points separated by the void, and wherein the composite slip and the cone are configured for application of a load therebetween that results in a fracture in the portions of material.

14. The assembly of claim 13, wherein the composite slip comprises an outer surface and an inner surface, wherein the void extends a distance from the outer surface to the inner surface.

15. The assembly of claim 13, wherein the composite slip comprises a plurality of slip segments, and each of the plurality of slip segments comprise inserts disposed therein, and wherein the load is in the range of about 1500 to about 2500 lbf.

16. The assembly of claim 15, wherein the composite slip and the cone comprise filament wound drillable material.

17. The assembly of claim 13, wherein the void comprises at least one groove that is cut at a back angle as measured from a central axis of the composite slip.

18. The assembly of claim 13, wherein the grooved area comprises at least one groove that is cut at a back angle in the range of about 45 degrees as measured from a central axis of the composite slip and at least one groove that is cut at a back angle in the range of about 30 degrees as measured from a central axis of the composite slip.

19. The assembly of claim 13, wherein a depth of the void is varied along the length of the grooved area.

20. A downhole tool useable for isolating sections of a wellbore, the downhole tool comprising:

a mandrel;

a composite slip disposed about the mandrel and configured for engagement with a tubular member, the composite slip comprising a one-piece configuration and having at least two grooves disposed therein, wherein the composite slip comprises a plurality of slip planar surfaces;

a cone disposed about the mandrel and having a first end-configured for engagement with the plurality of slip planar surfaces of the composite slip;

wherein the at least two grooves are disposed proximate to an area of intersection between two of the plurality of slip planar surfaces, wherein the composite slip comprises an outer surface and an inner surface, wherein one of the at least two grooves extends a depth between the outer surface to the inner surface, wherein the other of the at least two grooves extends a depth different from the one groove, and wherein setting of the downhole tool in the wellbore includes inducing a fracture between the at least two grooves, and moving the composite slip into gripping engagement with the tubular member.

21. The downhole tool of claim 20, wherein the cone comprises a plurality of cone planar surfaces configured to engage with the respective plurality of slip planar surfaces.

22. The downhole tool of claim 21, further comprising at least two grooves disposed proximate to each area of intersection between two of the plurality of slip planar surfaces.

23. The downhole tool of claim 21, further comprising raised surface disposed proximate to each area of intersection between two of the plurality of cone planar surfaces.

24. The downhole tool of claim 21, wherein the cone comprises a raised surface disposed proximate an area of intersection between the plurality of planar cone surfaces, and wherein the raised surface comprises a tapered surface converging toward a narrowed tip.

25. The downhole tool of claim 20, wherein the composite slip comprises a plurality of slip segments, and each of the plurality of slip segments comprises inserts disposed therein, and wherein during setting a complete fracture is induced between each slip segment.

26. The downhole tool of claim 20, wherein the fracture occurs at an applied load of about 1400 to about 2500 lbf.

27. The downhole tool of claim 20, wherein one of the at least two grooves is cut at a back angle in the range of about 20 degrees to about 90 degrees as measured from a central axis of the composite slip.

28. The downhole tool of claim 20, wherein the mandrel, the composite slip, and the cone comprise filament wound drillable material.

29. The downhole tool of claim 20, wherein at least one of the mandrel, the composite slip, and the cone is formed by wet winding one or more fibers having a phase angle of from about 30 degrees to about 70 degrees relative to a center line of the downhole tool.

30. The downhole tool of claim 29, wherein the one or more fibers pass through a resin bath prior to winding the fibers.

31. The downhole tool of claim 30, wherein one or more fibers comprise glass.

32. The downhole tool of claim 30, wherein one or more fibers comprise carbon.

33. The downhole tool of claim 30, wherein the one or more fibers are wound in the presence of an epoxy resin blend comprising bisphenol A, epichlorohydrin, and one or more cycloaliphatic epoxy resins.

34. The downhole tool of claim 20, wherein the mandrel, the cone, and the composite slip comprise filament wound material wound at an angle in the range of about 0 degrees to about 90 degrees.

35. The downhole tool of claim 20, wherein the slip expands at least 0.00005" during setting before fracture occurs.

36. The downhole tool of claim 20, wherein the slip expands in the range of about 0.00005" to about 0.001" before fracture.

37. The downhole tool of claim 20, wherein the composite slip comprises a plurality of slip segments, and each of the plurality of slip segments comprise inserts disposed therein.

38. The downhole tool of claim 20, wherein the downhole tool is a frac plug or a bridge plug.

39. The downhole tool of claim 20, wherein the material between the at least two grooves comprises first and second break points separated by one of the at least two grooves.

40. A method of setting a downhole tool in order to isolate one or more sections of a wellbore, the method comprising:

running the downhole tool into the wellbore to a desired position, the downhole tool comprising:

a mandrel;

a composite slip disposed about the mandrel and configured for engagement with a tubular member, the slip comprising a one-piece configuration and having at least two grooves disposed therein, wherein the composite slip comprises a plurality of slip planar surfaces;

a cone disposed about the mandrel and having a first configured for engagement with the plurality of slip planar surfaces of the composite slip;

wherein the at least two grooves are disposed proximate to an area of intersection between two of the plurality of slip planar surfaces, wherein the composite slip comprises an outer surface and an inner surface, wherein one of the at least two grooves extends a depth between the outer surface to the inner surface, and wherein the other of the at least two grooves extends a depth different from the one groove, placing the tool under a load that causes the cone to forcibly engage the composite slip, wherein the composite slip breaks and expands radially outward into gripping engagement with a surrounding tubular when the load exceeds a predetermined value; and disconnecting the downhole tool from a setting device coupled therewith.

41. The method of claim 40, wherein the break occurs in the material between the at least two grooves.

42. The method of claim 40, further comprising injecting a fluid from the surface into the wellbore, and subsequently into at least a portion of subterranean formation in proximate vicinity to the wellbore.

43. The method of claim 42, wherein the fluid is a frac fluid, and wherein the frac fluid is injected into at least a portion of the subterranean formation that surrounds the first section of the wellbore.

44. The method of claim 43, the method further comprising:

performing a fracing operation;

setting a second downhole tool; and drilling through at least one of the downhole tool, the second downhole tool, or both.

45. The method of claim 40 further comprising flaring the composite slip radially outwardly during setting before fracture occurs.

46. The method of claim 40 further comprising flaring the composite slip radially outwardly before fracture.

47. The method of claim 40, wherein the composite slip breaks by fracturing material between the at least two grooves at a first and second break points separated by one of the at least two grooves.

* * * * *

UNITED STATES PATENT AND TRADEMARK OFFICE

CERTIFICATE OF CORRECTION

PATENT NO. : 9,157,288 B2
APPLICATION NO. : 13/553785
DATED : October 13, 2015
INVENTOR(S) : Edgar Martinez It is certified that error appears in the above-identified patent and that said Letters Patent is hereby corrected as shown below:

In the specification,

Column 3, line 29, cancel text "have an axis of unexpanded outer radius of curvature that may" and insert the following text --have an axis of unexpanded outer curvature that may--.

In the claims,

Claim 13, column 19, line 50 and 51, cancel text "wherein the grooved region comprises a void and a-portions of material," and insert the following text --wherein the grooved region comprises a void and portions of material,--.

Signed and Sealed this
Fifth Day of April, 2016

Michelle K. Lee

Michelle K. Lee
*Director of the United States Patent and Trademark Office*